US006585455B1

(12) United States Patent
Petersen et al.

(10) Patent No.: US 6,585,455 B1
(45) **Date of Patent: *Jul. 1, 2003**

(54) ROCKER ARM MARINE TENSIONING SYSTEM

(75) Inventors: William Henry Petersen, Mandeville, LA (US); Robert Wayne Patterson, Mandeville, LA (US)

(73) Assignee: Shell Oil Company, Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/752,409

(22) Filed: Nov. 19, 1996

Related U.S. Application Data

(63) Continuation of application No. 07/931,795, filed on Aug. 18, 1992, now abandoned.

(51) Int. Cl.[7] ..... E21B 41/04; B66C 23/53

(52) U.S. Cl. ..... 405/224.4; 405/223.1; 166/355; 212/308

(58) Field of Search ..... 405/224, 195.1, 405/223.1, 224.1–224.4; 166/350, 359, 367, 355; 175/5, 7, 27; 114/230, 264, 265, 256; 267/128, 125; 254/277, 392; 212/308

(56) References Cited

U.S. PATENT DOCUMENTS

| | | | | |
|---|---|---|---|---|
| 2,069,270 A | | 2/1937 | Piron | |
| 2,492,049 A | | 12/1949 | Krone et al. | |
| 2,762,660 A | | 9/1956 | Bullock | |
| 2,927,786 A | | 3/1960 | Templeton | |
| 3,101,798 A | * | 8/1963 | Wilson et al. | 166/355 X |
| 3,307,514 A | * | 3/1967 | Young | 114/230 |
| 3,498,472 A | | 3/1970 | Rodgers et al. | |
| 3,508,409 A | | 4/1970 | Cargile, Jr. | |
| 3,528,497 A | | 9/1970 | Lehman | |
| 3,739,844 A | | 6/1973 | Peterman et al. | |
| 3,788,073 A | | 1/1974 | Castela et al. | |
| 3,788,074 A | | 1/1974 | Castela et al. | |
| 3,831,920 A | | 8/1974 | Meldrum et al. | |

(List continued on next page.)

FOREIGN PATENT DOCUMENTS

| | | |
|---|---|---|
| GB | 2060253 A | 10/1979 |
| GB | 2184043 A | 6/1987 |
| GB | 2204898 | 11/1988 |
| GB | 2227692 A | 8/1990 |
| GB | 2229116 A | 9/1990 |
| GB | 2250763 A | 6/1992 |
| GB | 2251874 A | 7/1992 |
| WO | WO-88/00273 | 1/1988 |

OTHER PUBLICATIONS

Twenty–eight (28) sheets of drawings originating with Murdock Engineering Co. (These have been numbered in the upper right–hand corner as pp. 1–28 for the convenience of the Examiner.).

Maritime Hydraulics Advertisement for "Top Mounted Drill String Compensators."

"Auger Field Challenger Drive TLP Designer Innovation", by C. McCabe, *Ocean Industry,* Aug. [19] 1991.

"Some Practical Design Details", Chapter 8, *Engineering Design with Rubber,* pp. 201–211.

*Primary Examiner*—Thomas B. Will
*Assistant Examiner*—Tara L. Mayo

(57) ABSTRACT

A tensioning riser system for supporting marine elements such as risers which extend form a fixed lower end at a subsea base or foundation to a moving, floating superstructure. The tensioning system has a lever arm pivotally connected to both the superstructure and the upper end of the marine element and a tension controlling strut member pivotally connected to both the superstructure and the lever arm.

60 Claims, 18 Drawing Sheets

U.S. PATENT DOCUMENTS 3,831,922 A 8/1974 Appleton
3,889,747 A 6/1975 Regan et al.
3,905,319 A 9/1975 Schuh
4,004,532 A 1/1977 Reynolds
4,084,801 A 4/1978 Landers et al.
4,088,089 A * 5/1978 Flory ..... 114/230
4,215,950 A * 8/1980 Stevenson ..... 166/359 X
4,359,095 A 11/1982 Goldsmith
4,364,323 A 12/1982 Stevenson
4,379,657 A 4/1983 Widiner et al.
4,423,983 A 1/1984 Dadiras et al.
4,432,420 A * 2/1984 Gregory et al. ..... 166/355
4,449,856 A 5/1984 Tokoro et al.
4,459,930 A * 7/1984 Flory ..... 141/387 X
4,473,323 A 9/1984 Gregory
4,494,738 A 1/1985 Britton et al.
4,577,842 A 3/1986 Shtarkman
4,616,707 A 10/1986 Langner
4,617,998 A 10/1986 Langner
4,640,487 A 2/1987 Salter
4,662,786 A 5/1987 Cherbonnier
4,662,791 A 5/1987 Spicer
4,663,843 A 5/1987 Savage
4,729,694 A 3/1988 Peppel
4,733,991 A 3/1988 Myers
4,759,662 A 7/1988 Peppel
4,787,778 A 11/1988 Myers et al.
4,799,827 A 1/1989 Jaqua
4,808,035 A 2/1989 Stanton et al.
4,883,387 A 11/1989 Myers et al.
4,883,388 A 11/1989 Cherbonnier
4,886,397 A 12/1989 Cherbonnier
4,892,444 A 1/1990 Moore
5,160,219 A 11/1992 Arlt
5,282,434 A * 2/1994 Hart et al. ..... 144/230
5,366,324 A 11/1994 Arlt et al. ..... 405/195.1
5,433,423 A * 7/1995 Whightsil ..... 267/141
5,658,095 A * 8/1997 Arlt et al. ..... 405/195.1

* cited by examiner

ROCKER ARM MARINE TENSIONING SYSTEM

This is a continuation Ser. No. 07/931,795 filed on Aug. 18, 1992 now abandoned.

BACKGROUND OF THE INVENTION

The present invention relates to a tensioning system and, more particularly, a tensioning system for supporting a marine element such as a riser extending between a subsea base and a surface termination.

Tensioning systems are required to maintain a substantially constant tension in such vertical members despite the effects of wave and current on the floating superstructure which continually shifts, shortening and then lengthening the distance between the base fixed on the sea floor and the moving superstructure. The need for a constant tension, motion compensating device varies with the application. Thus, the compensation may serve to limit the load on vertical mooring lines such as cable tethers of a TLP or avoid excessive tension, compression or bending loads on tubular goods such as risers.

Risers connecting surface facilities with a subsea base present a particular problem in offshore drilling and production systems including drill ships, semi-submersible vessels and other non-bottom founded designs. Even some bottom founded platform designs such as articulated or compliant towers may have sufficient movement between topside facilities and the riser to require compensation. Uncompensated support may allow the riser to build a net compressive load sufficient to buckle the riser, collapsing the pathway within the riser necessary for drilling or production operations. Alternatively, excess tension from uncompensated support can also damage the riser.

Further, the relative motion between risers and surface facilities is a problem even for oil and gas operations from tension leg platforms ("TLP's") which are designed to minimize the wave response of the floating superstructure.

SUMMARY OF THE INVENTION

An object of the present invention is to provide a tensioning system for supporting one end of a marine element from a superstructure which is in relative motion therewith. It is a further object of the present invention to provide favorable dynamic responses of applied force and stroke length to such a tensioning system in its support of a marine element.

Another object of the present invention is to provide a tensioning system for maintaining oil and gas production risers in substantially constant tension in offshore applications in which one end of the riser is fixed at the sea floor and the other end of the riser is secured to a moving superstructure through the tensioning system.

It is a further object of the present invention to provide a riser tensioning system which facilitates ease of offshore maintenance and/or replacement of the tensioning controlling members.

Finally, it is an object of the present invention to provide a system to accommodate the use of a fixed derrick on an oil and gas platform from which a plurality of wells will be drilled by offsetting the platform, the device facilitating the acceptance of production risers in tensioning equipment offset from the drilling facilities.

Toward the fulfillment of these and other objects according to the tensioning system of the present invention, a tensioning system is provided for supporting marine elements such as risers which extend from a fixed lower end at a subsea base or foundation to a moving, floating superstructure. The tensioning system has a lever arm pivotally connected to both the superstructure and the upper end of the marine element and a tension controlling strut member pivotally connected to both the superstructure and the lever arm. This aspect of the tensioning system facilitates control of dynamic response by deploying tension controlling elements which are limited in force and movement to their optimal range, yet afford matching of applied force and stroke length for an offshore application through the lever arm configuration.

Another aspect of the present invention facilitates maintenance and replacement of tension controllers with the use of a mounting ramp to provide initial tension in a mechanical spring embodiment.

A further aspect of the present invention is an improved pressure charged elastomeric energy cell.

BRIEF DESCRIPTION OF THE DRAWINGS

The above brief description as well as further objects, features and advantages of the present invention will be more fully appreciated by reference to the following detailed description of the presently preferred, but nonetheless illustrative, embodiment of the present invention with reference to the accompanying drawings in which.

DETAILED DESCRIPTION OF THE PREFERRED EMBODIMENTS

Figure 1:
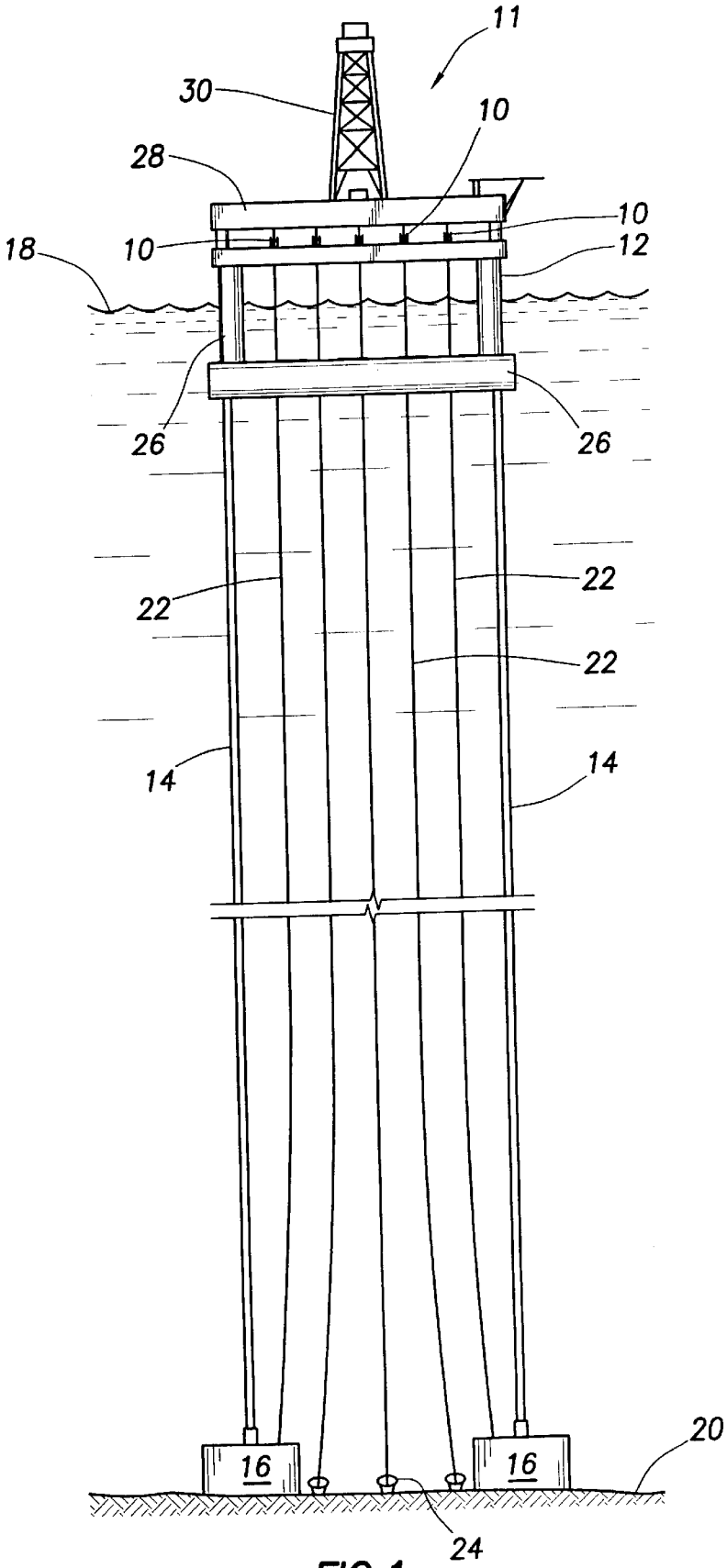
FIG. 1 is a side elevational view of a tension leg platform employing a tensioning system in accordance with the present invention.

FIG. 1 illustrates a tension leg platform ("TLP") application of a plurality of tensioning elements 10 constructed in accordance with the present invention. TLP 11 has a floating superstructure 12 which is restrained below its free floating draft at the ocean surface 18 by a plurality of tendons 14 connected between the superstructure and a subsea foundation 16 secured on ocean floor 20. Thus secured, the excess buoyancy of the TLP substantially reduces but does not entirely eliminate the action of waves and currents on superstructure 12.

The TLP's floating superstructure 12 has buoyant hull members 26 including horizontal pontoons and vertical columns which support one or more decks 28 which carry the necessary drilling and production equipment, represented schematically here with derrick 30.

A plurality of risers 22 extend from subsea wellheads 24 to carry the produced hydrocarbons from the ocean floor to processing facilities on floating superstructure 12. Tensioning elements 10 constructed in accordance with the present invention compensate for the relative movement between the upper ends of risers 22 and floating superstructure 12 to maintain the risers in controlled tension to prevent damage which would restrict the flow path and threaten the structural integrity of the riser.

Figure 2:
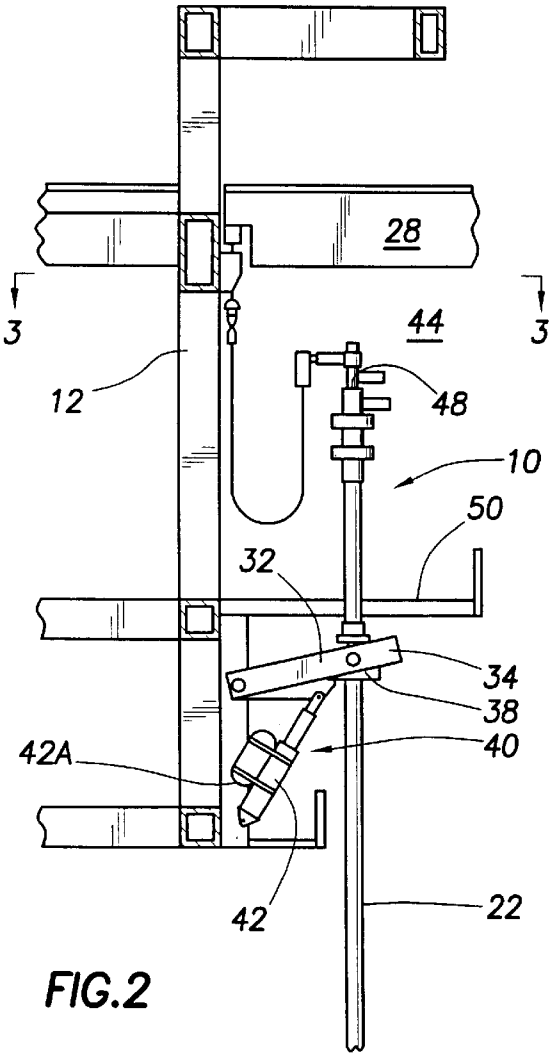
FIG. 2 is a side elevational view of a tensioning system in accordance with the present invention deployed within a tension leg platform.

FIG. 2 illustrates a tensioning system 10 in accordance with the present invention in support of riser 22 in the production mode of a TLP application. Riser 22 is supported by superstructure 12 through lever arm 32. A fulcrum connection 36 pivotally connects the elongated extension of rocker arm 34 in lever arm 32 to the superstructure and a load connection 38 pivotally connects rocker arm 34 to riser 22. A tension controlling strut member 40 is pivotally attached to both superstructure 12 and rocker arm 34 and provides a tension controller 42, here illustrated as hydraulic cylinder 42A.

Figure 3:
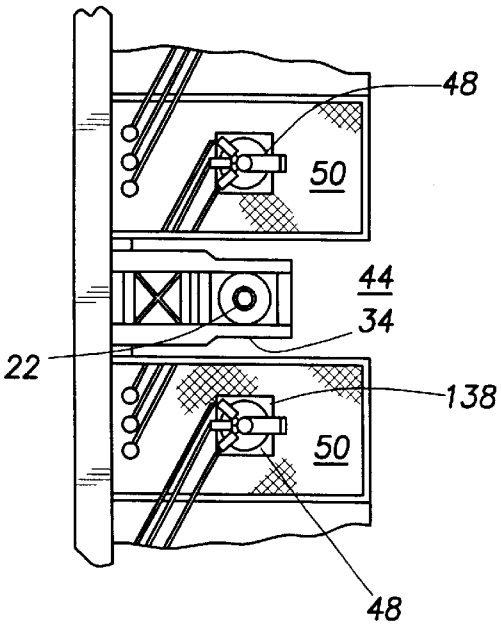
FIG. 3 is a top elevational view of the tensioning system of FIG. 2 as viewed from line 3—3 of FIG. 2.

In the illustrated TLP application, production riser 22 is hung off in riser tensioning system 10 within well bay 44 beneath deck 28. A flexible conduit 46 connects a Christmas tree 48 of the surface completion at the top of the riser to production facilities within TLP 11. Catwalks, walkways and work platforms 50 may be used to provide convenient worker access for well operations at Christmas tree 48 and for maintenance of tensioning system 10. Refer also to FIG. 3 which is an overhead view of a section of well bay 44 beneath deck 28. A plurality of Christmas trees 48 are shown extending through slots in work platform 50, a portion of which has been broken away to reveal an overhead view of rocker arm 34 of tensioning system 10.

Figure 5:
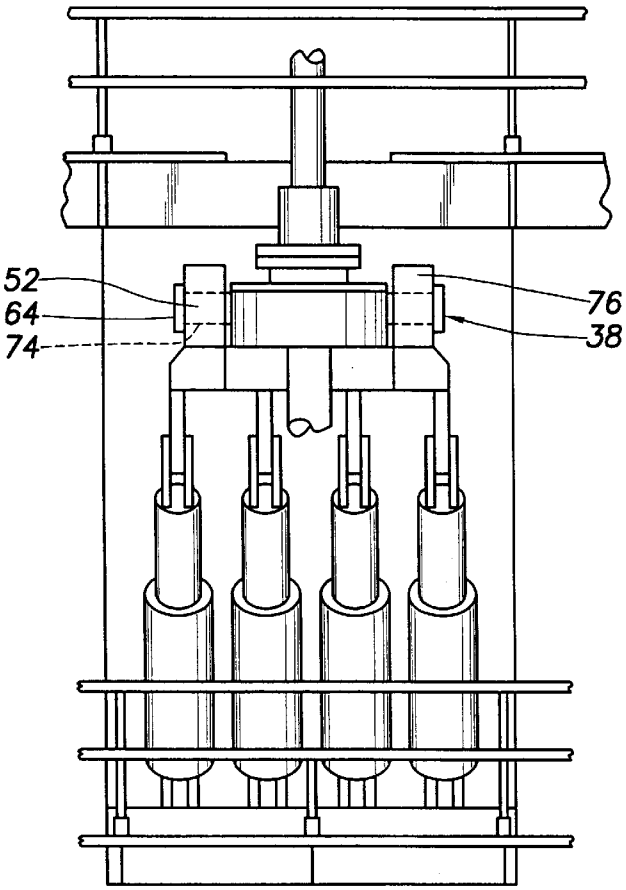
FIG. 5 is a front elevational view of the tensioning system of FIG. 4 as viewed from line 5—5 of FIG. 4.
Figure 4:
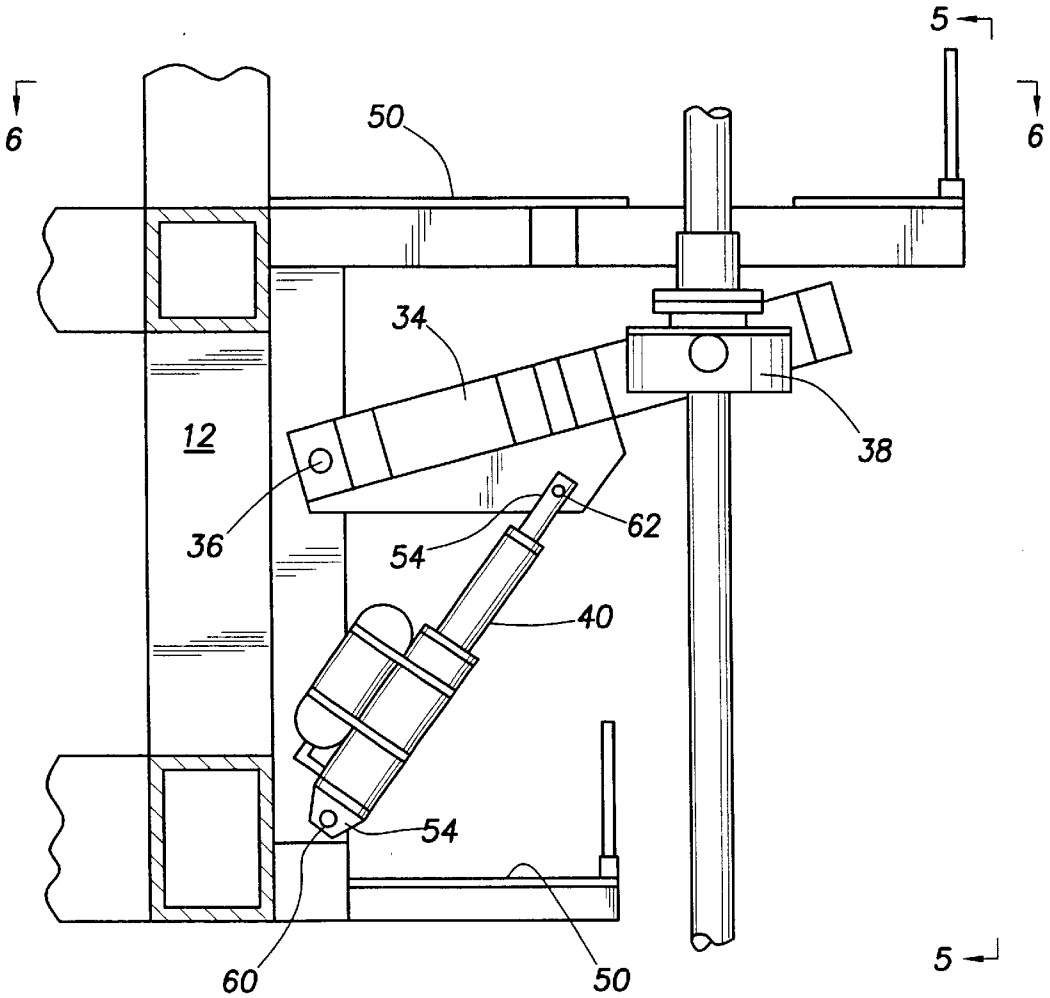
FIG. 4 is a side elevational view of a tensioning system constructed in accordance with the present invention.
Figure 6:
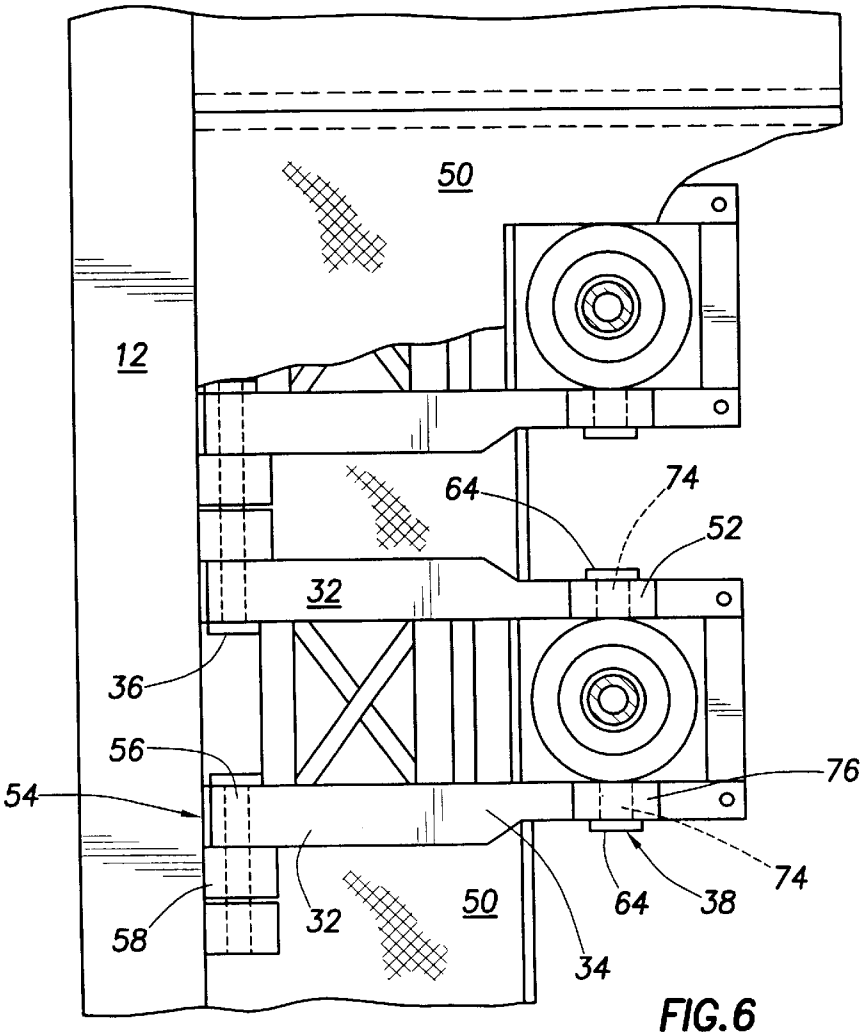
FIG. 6 is a top elevational view of the tensioning system of FIG. 5 taken at line 6—6 of FIG. 4.

FIGS. 4, 5 and 6 illustrate an embodiment of tensioning system 10 in greater detail. For the purposes of this illustration, a portion of rocker arm 34 has been broken away in the side view of FIG. 4 to reveal load connection 38, here a gimbal assembly 52. See also FIG. 7. Returning to FIGS. 4–6, riser 22 is attached to rocker arm 34 through load connection 38 which pivots to permit the riser to retain a substantially vertical orientation despite the arcuate movement of rocker arm 34. The rocker arm is pivotally attached to superstructure 12 through fulcrum connection 36, here provided by a pin and clevis assembly 54 in which a pin 56 passes through lever arms 32 and a clevis member 58. Control over the reactive force supporting the load of riser 22 is provided by tension controlling strut member 40 which is pivotally connected to superstructure 12 at a first strut or strut base connection 60 and pivotally connected to rocker arm 34 at a second strut or rocker arm hinge connection 62. Both the rocker arm base and hinge connections may be conveniently provided by pin and clevis assemblies 54. Various bearing assemblies may be incorporated into the pin and clevis assemblies.

The front view of FIG. 5 illustrates an embodiment having multiple tension controlling strut members 40 ganged in parallel. This arrangement facilitates maintenance and replacement of tension controllers 42 and provides redundancy to protect against damage from the possible failure of a tension controller in service.

Figure 7:
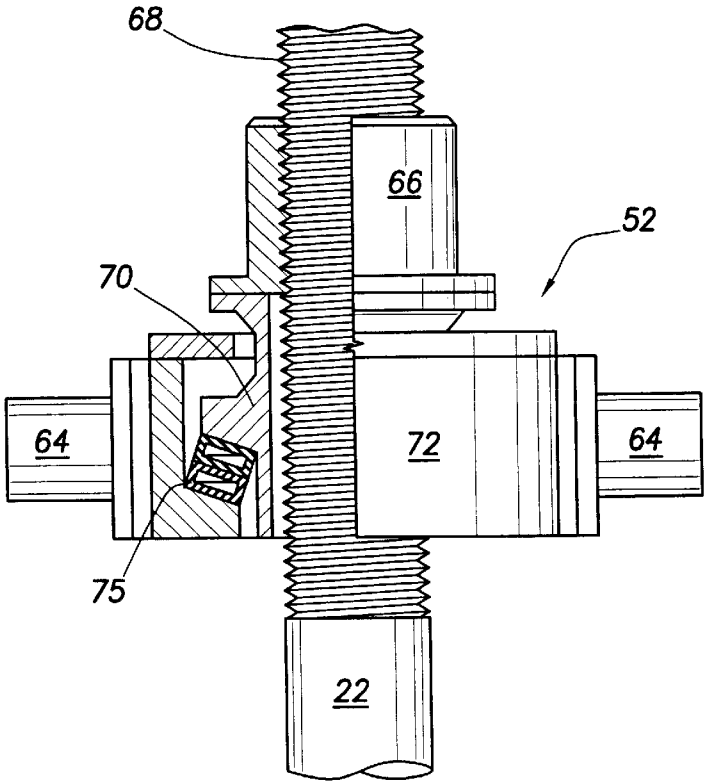
FIG. 7 is a partially cross-sectional front view of a load connection for pivotally attaching a marine element to a lever arm in accordance with one embodiment of the present invention.

FIG. 7 illustrates the gimbal assembly in greater detail, including its connection to riser 22. In this embodiment, the upper extension of riser 22 provides a threaded region 68 which a cap nut 66 threadingly and adjustably engages. The cap nut is supported by a space out adaptor 70 which is in turn supported by gimbal 72 through an annular elastomeric bearing 75. The gimbal projects opposing pivot pins 64 suitable for making a pivoting connection to hang riser 22 secured to gimbal assembly 52 off rocker arm 34. See FIG. 6.

FIG. 6 illustrates an embodiment in which a plurality of lever arms 32 are combined into a single rocker arm 34. Each of lever arms 32 supports a pivot pin 64 of gimbal assembly 52. In this embodiment, pivot pins 64 seat within recesses 74 in lever arms 32 and are secured with caps 76. See also FIG. 5.

Figure 7A:
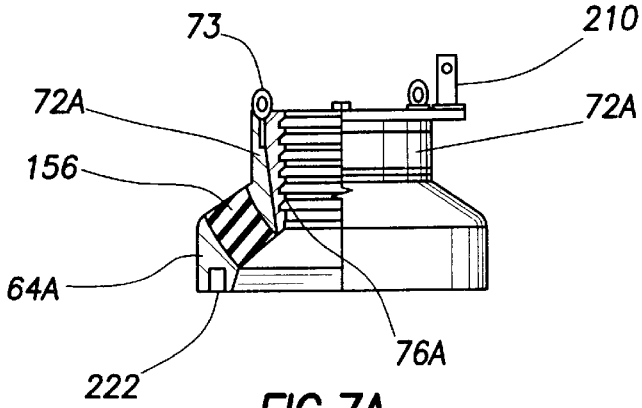
FIG. 7A is a partially cross sectional view of an alternate and presently preferred load connection.

FIG. 7A discloses an alternate and presently preferred embodiment of load connection 38. Here space out adaptor 70A is formed by a segmented annular locking member 76A which is fir about riser 22 (removed from this Figure for the sake of simplicity), the interior of which is grooved to securely engaged a ringed portion 68A of riser 22. See FIG. 18. The outside of locking member 76A is wedge shaped and cooperates with the upper bearing housing 72A to force a tight reception against a riser when loaded. This may be further secured about the riser for low load conditions, e.g., riser installation, with bolts 73. An annular elastomeric bearing 156 flexible joins upper bearing housing 72 to load ring 64A to provide for motion compensation as riser 22 moves relative to load ring 64A. Load ring 64A is configured to fit into seat 74A presented at the periphery of keyhole slot connection 52A. See FIG. 16.

Many variations for tension controller 42 may be suitable for use in the marine tensioning system of the present invention. Each presents different capabilities in terms of strength, weight, response characteristics, reliability, durability and maintenance requirements. FIGS. 8A–8F illustrate some of the alternate embodiments for tension controller 42 within tension controlling strut member 40 of tensioning systems in accordance with the present invention.

Figure 8B:
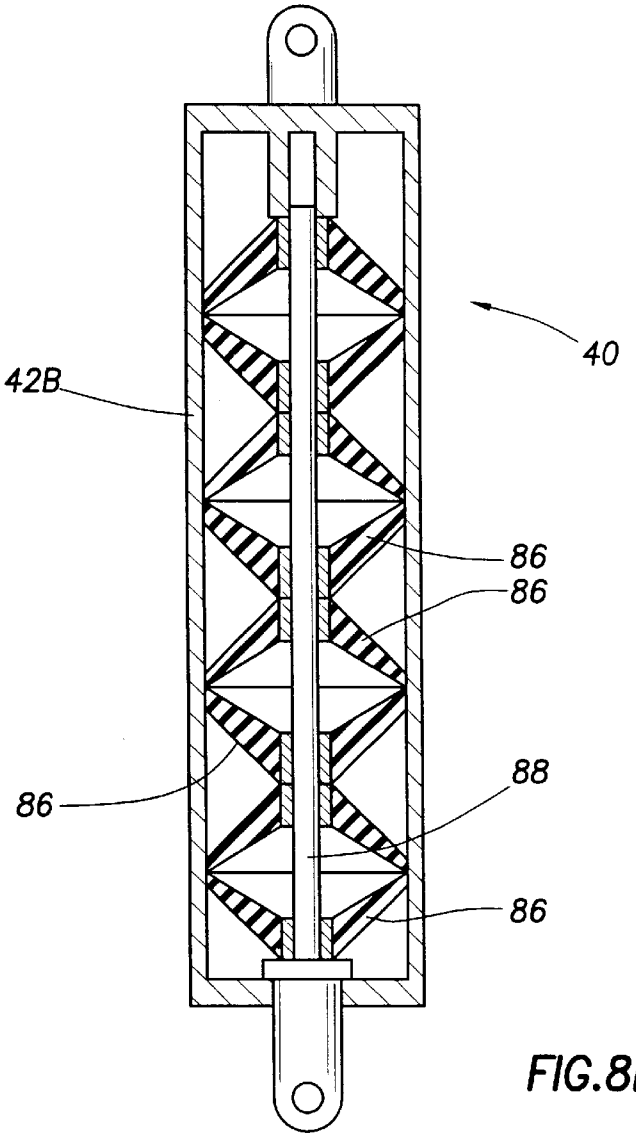
FIG. 8B is a longitudinal cross sectional view of a compression disk tension controller for use in an alternate embodiment of a tensioning system constructed in accordance with the present invention.
Figure 8A:
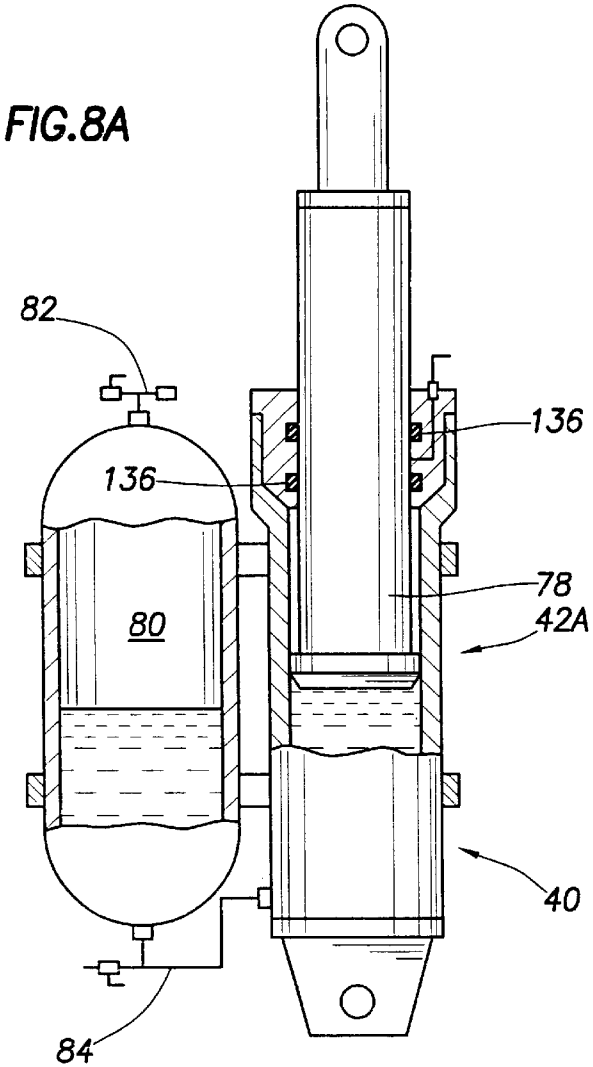
FIG. 8A is a partially cross-sectional side view of a hydraulic tension controller for use in one embodiment of a tensioning system constructed in accordance with the present invention.

FIG. 8A discloses the use of a hydraulic cylinder 78 driven through hydraulic lines 84. However, in this embodiment the hydraulic cylinder is combined with pressure charged pneumatic reservoir 80 to provide a combined pneumatic/hydraulic tension controller 42A. The dynamic response of pneumatic/hydraulic tension controller 42A is adjustable with changes in gas pressure through valves 82.

Figure 8E:
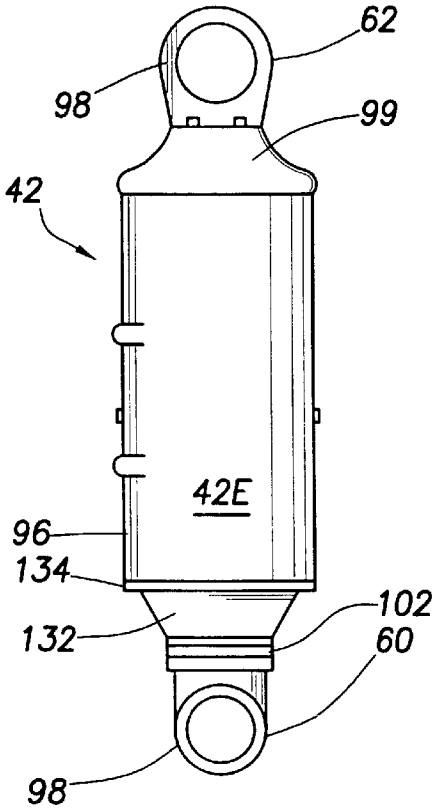
FIG. 8E is a side elevational view of the presently preferred embodiment of a pressurized elastomeric energy cell for use in the practice of the present invention.
Figure 8D:
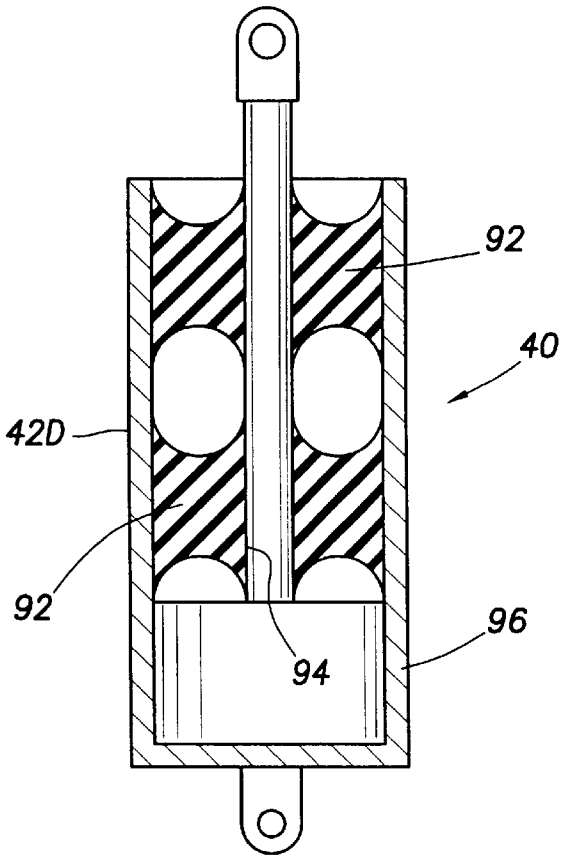
FIG. 8D is a longitudinal cross sectional view of a pressurized elastomeric energy cell for use as a tension controller in an alternate embodiment of a tensioning system constructed in accordance with the present invention.
Figure 8C:
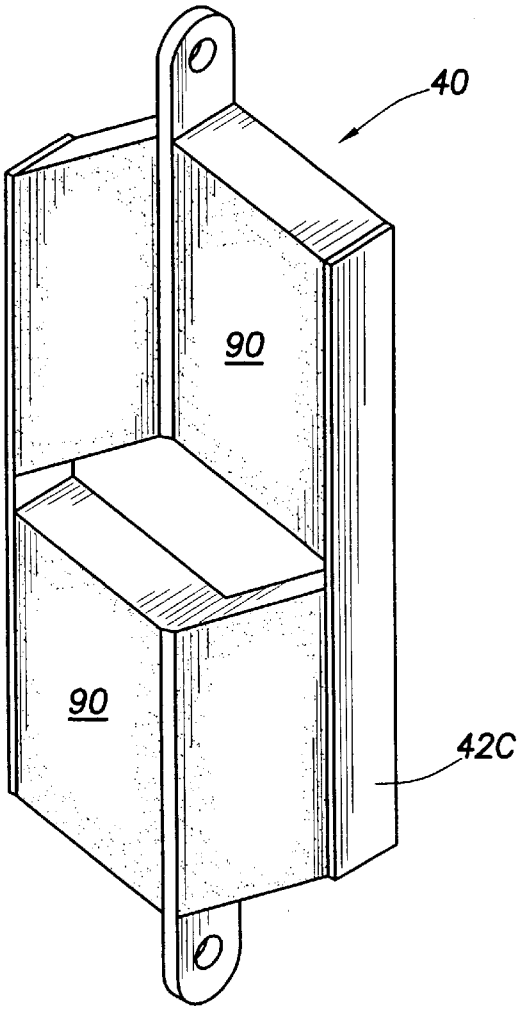
FIG. 8C is a perspective view of an elastomeric mechanical spring tension controller for use in an alternate embodiment of a tensioning system constructed in accordance with the present invention.

Each of FIGS. 8B–8D illustrate tension controllers formed with mechanical spring elements. Opposing convex and concave pairs of metal discs 86 are slidably strung along a central rod 88 to form a spring tension controller 42B in FIG. 8B. An alternate mechanical spring is presented in FIG. 8C in which spring energy is stored in a shear strain between parallel layers of elastomeric pads 90 in tension controller 42C. FIG. 8D illustrates another use of elastomer members in which a plurality of annular elastomeric elements 92 connect inner and outer cylinders 94 and 96, respectively, to form elastomeric shock cell tension controller 42D. The performance characteristics of this latter tension controller, elastomeric shock cell 42D, may be enhanced with a pressure charging system using air or nitrogen.

Figure 8F:
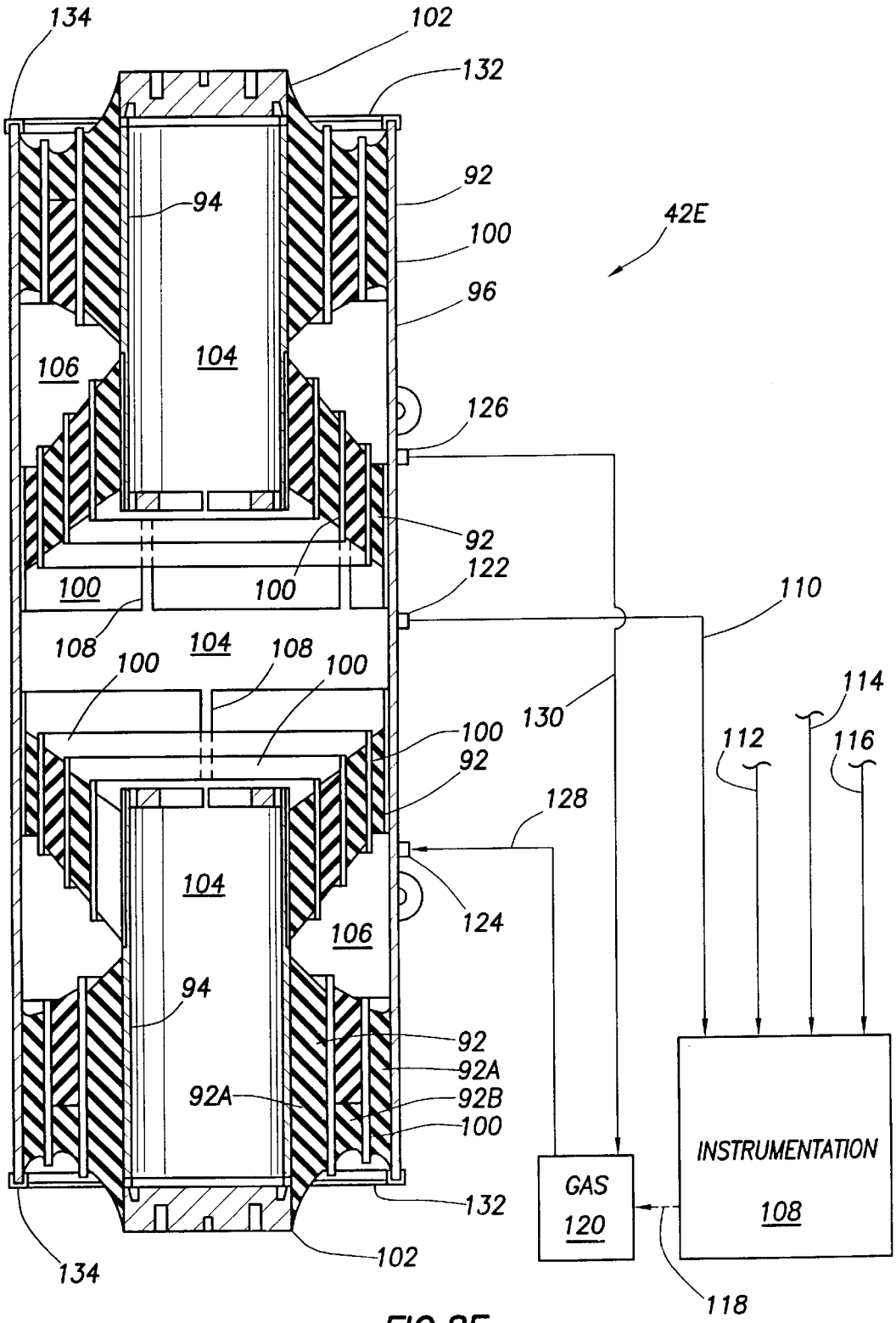
FIG. 8F is a longitudinal cross sectional view of the pressure charged elastomeric energy cell of FIG. 8E which includes a schematic representation of instrumentation.

FIGS. 8E–8F illustrate the presently preferred embodiment for tension controller 42, pressure charged elastomeric energy cell 42E. FIG. 8E is an elevational view of the elastomeric energy cell which includes a pad eye 98 mounted on each end for the strut base and hinge connections 60 and 62, respectively. A boot 99 provides additional protection for the elastomeric members in energy cell 42E.

The construction and operation of the elastomer energy cell 42E is best illustrated with reference to the cross section view of FIG. 8F in which pad eyes 98 have been removed from load plates 102. Inner cylinders 94 are mounted in non-abutting coaxial alignment within outer cylinder 96 and connected therewith by elastomeric elements 92, permitting the inner cylinders 94 to slide within and out of outer cylinders 96. Extreme loads in tension controller 42E necessary for riser support in deepwater applications may tend to distort annular elastomeric elements 92, diminishing their ability to respond as necessary to maintain a substantially constant tension in the supported marine element. It is therefore necessary to effectively maintain the alignment of inner and outer cylinders 94 and 96. This can be accomplished by means for restraining relative alignment between the inner and outer cylinders, such as by guides or stiffening elements. Thus, a guide rod telescopically received into the ends of both of the opposing inner cylinders would serve to maintain proper geometry. Alternative guide means might be provided between the inner and outer cylinders by rollers or annular bearings, which not only maintain geometry, but help overcome friction between inner cylinders 94 and outer cylinders 96. Alternatively, the preferred embodiment preserves load bearing geometry by stiffening elastomeric elements 92 with annular metal shims 100 which divide elastomeric elements 92 into a plurality of bonded layers 92A. In addition, the response of elastomeric elements 92 may be modified by using combinations of elastomeric compositions in either alternate layers 92A or within a single layer 92B.

In this preferred embodiment, the interior of outer cylinder 96 in elastomeric energy cell 42E is pressure charged with a compressible fluid such as air or nitrogen. The outer cylinder is divided into three chambers, one central chamber 104 and two annular chambers 106. The central chamber includes the communicating volumes within and between inner cylinders 94. Annular chambers are defined radially between inner cylinder 94 and outer cylinder 96 and axially between adjacent elastomeric elements 92 joining the outer cylinder to an inner cylinder. Pressure is equalized between the central and annular chambers across interior elastomeric elements 92 through vents or apertures in the wall of inner cylinders 94 or, as illustrated, through vents or channels 108 through shims 100. Placing these channels in a shim rigidly attached to the inner surface of outer cylinder 96 minimizes any adverse affect of such perforations to the performance of elastomeric elements 92. No vents are provided around the outer or endmost elastomeric elements 92 so that a pressure seal is maintained by the elastomeric elements across the inner to outer cylinder annulus at the terminal ends of outer cylinder 96. Load plates 102 seal the outer ends of inner cylinders 94 to complete pressure containment. A secondary pressure seal may be provided by seat or end plate 132 and sealing rim 134.

Instrumentation and pressure charging facilities are schematically illustrated in FIG. 8F. Instrumentation 108 receives input from a suite of sensors regarding the status and operation of tensioning system 10. Pressure sensor 122 is connected to instrumentation 108 through lead 110 to provide one of four signals monitored in the preferred embodiment. Additional sensors measuring the force on the energy cells, the angle of the rocker arm and the angle of the riser are connected to the instrumentation through leads 112, 114, and 116, respectively. The instrumentation produces signals which are used to control pressure charging system 120. Valve 124 is provided through outer cylinder 96 for charging the elastomer energy cell of the tensioning system through pneumatic line 128 which is connected to charging system 120. The charging system also controls a valve 126 venting through the outer cylinder for pressure reduction. If a nitrogen charging system is used, it may be desirable to provide a line 130 returning the vented nitrogen to pressure charging system 120.

Figure 9B:
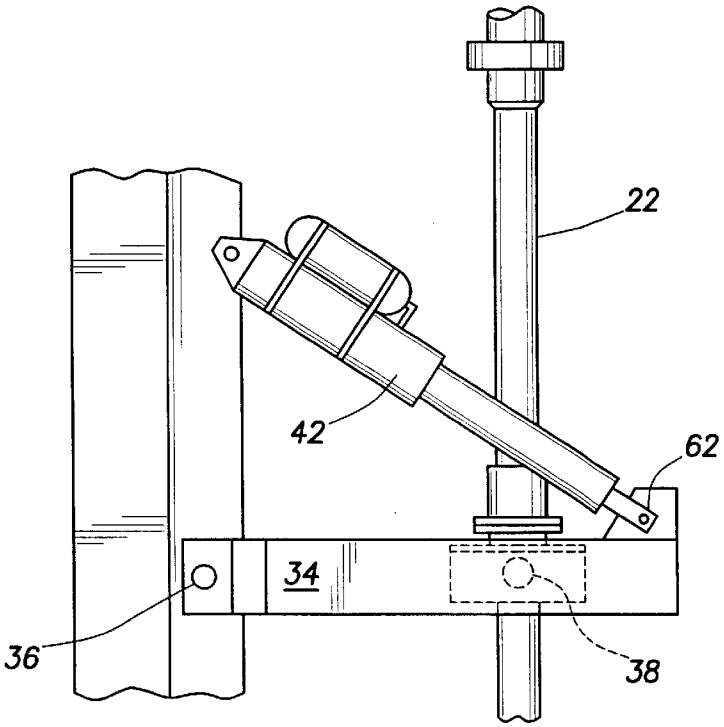
FIG. 9B is another alternate embodiment of a tensioning system constructed in accordance with the present invention illustrating another lever arm configuration.
Figure 9A:
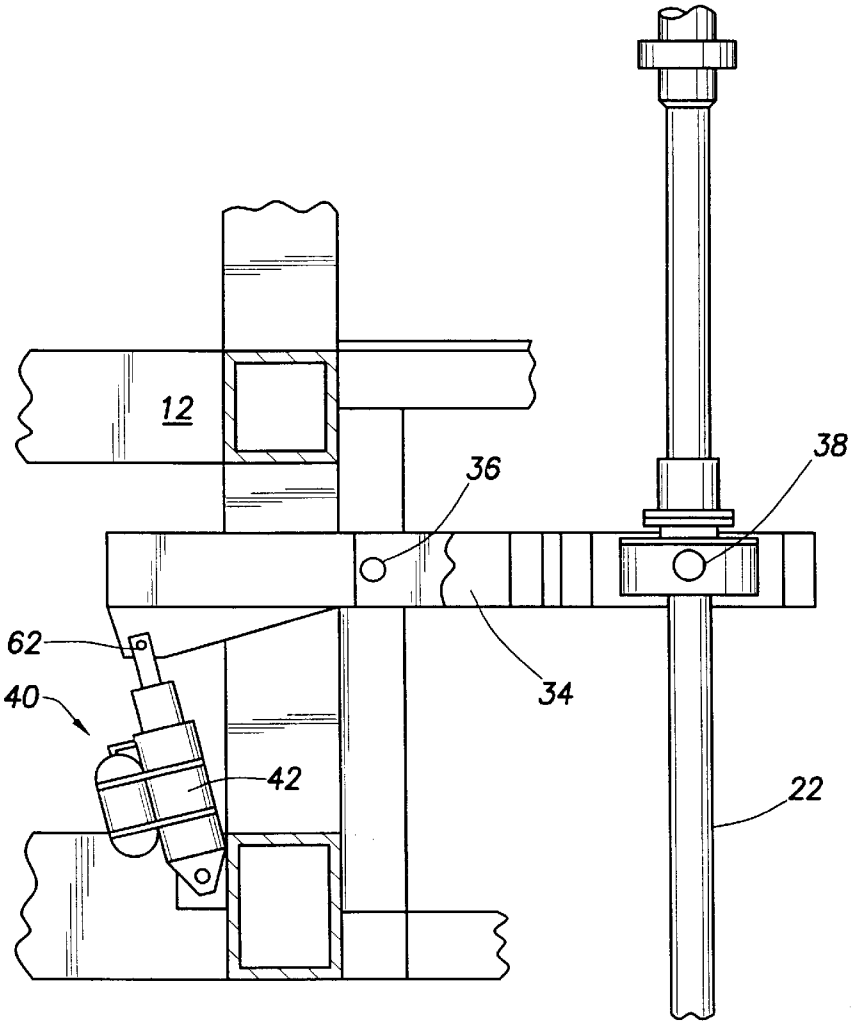
FIG. 9A is a side elevational view of an alternate embodiment of a tensioning system constructed in accordance with the present invention illustrating another lever arm configuration.

FIGS. 9A and 9B illustrate some alternate configurations for the interconnection of a marine element such as riser 22, rocker arm 34, superstructure 12 and tension controlling strut member 40 formed by shifting the relative positions of fulcrum connection 36, load connection 38 and rocker arm hinge connection 62 along the rocker arm. The tension controllers 42 may be connected directly to the rocker arm 34 or through intermediary lugs 35. Further, the tension controllers 42 within strut members 40 may be operated in compression as shown in FIG. 4 or in tension as illustrated in FIGS. 9A and 9B by inverting the relative position of the strut for a given fulcrum, load and rocker arm hinge relation and modifying the tension controller as necessary. Generally, it is preferred to have the tension controller 42 acting in compression as in FIG. 4 rather than in tension as in FIGS. 9A and 9B.

Compression loading provides additional security should the tension controller fail and, in the case of hydraulic rams, seals 136 at the outward edge of the cylinder (see FIG. 8A) are more readily accessible for maintenance or replacement in compression service than for tension service which ordinarily requires seals at both ends of the piston assembly and therefore requires removal of the piston before servicing the innermost seals. The latter service operation has the disadvantage that tension controlling strut member 40 must ordinarily be removed from tensioning system 10 to permit piston removal for servicing the seals.

Figure 10B:
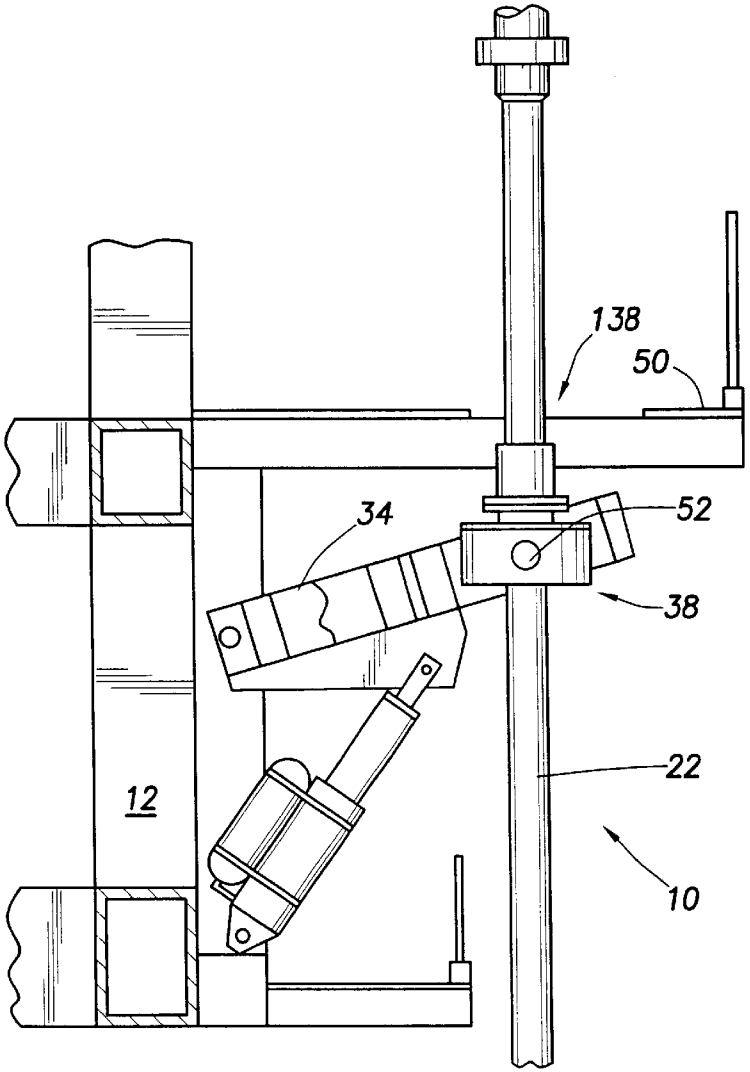
FIG. 10B is a side elevational view of the tensioning system of FIG. 10A in which the riser is at the top of its stroke.
Figure 10A:
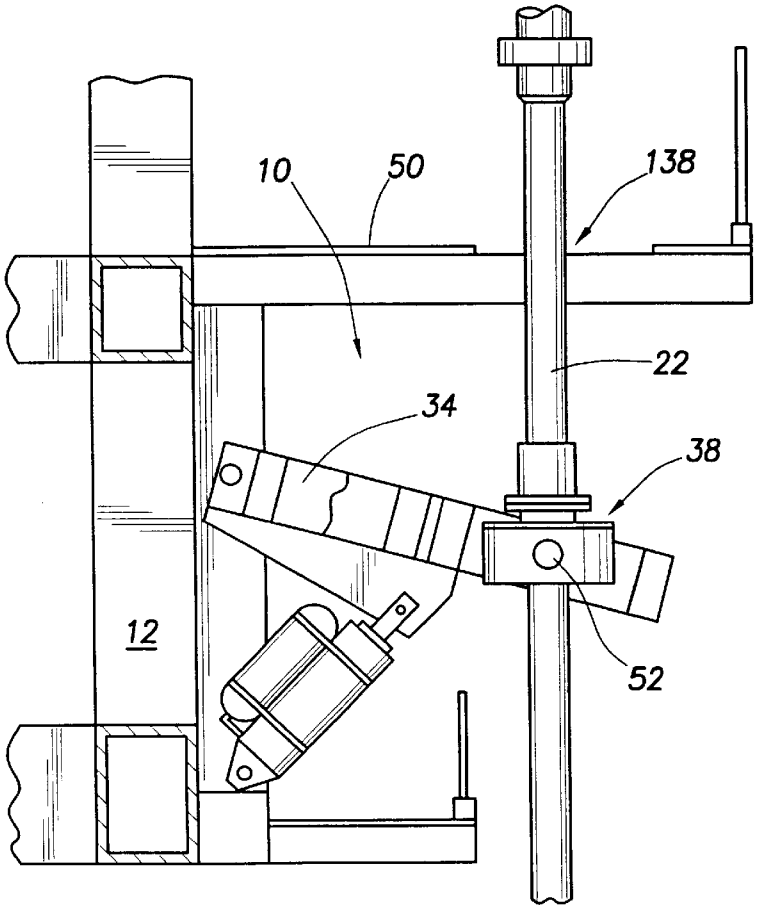
FIG. 10A is a side elevational view of a tensioning system supporting a marine riser at the bottom of its stroke.

FIGS. 10A and 10B illustrate tensioning system 10 in normal, passive operation. The tensioning system supports a marine element such as riser 22 from a moving superstructure 12. However, the risers are secured at their base to a fixed position on the ocean floor and the top of the riser is therefore in relative motion with its supporting superstructure. The integrity of the riser is jeopardized by the load fluctuations inherent in this supporting relationship and the purpose of the tensioning system is to accommodate this relative motion while maintaining substantially constant tension on the marine element.

A portion of rocker arm 34 has been broken away in FIGS. 10A and 10B to demonstrate the relative angular motion between rocker arm 34 and riser 22 through pivoting load connection 38. In this embodiment, the load connection is provided by gimbal assembly 52 which permits the relative angular motion that results from articulating an extended vertical riser with the arcuate motion inherent in the use of rocker arm 34 in tensioning system 10. Although the tensioning system and riser are oriented such that the substantially vertical riser tangentially intersects the arcuate motion of the rocker arm at the load connection, the arcuate motion of rocker arm 34 nevertheless contributes a horizontal component to the substantially vertical relative motion of riser 22. Although this has negligible effect in terms of angular flexure at the base of the riser in deepwater applications, the horizontal component must be accommodated in topside facilities, such as well slots 138 in catwalk 50.

Tensioning system 10 can also be used in an active manner, to deliberately change the reactive force transmitted to the marine element. This may be useful to accommodate increased loads on the riser, e.g., for additional equipment supported by the riser such as wireline tools for workover of a well. Alternatively, it may be desired to alter the dynamic response of a marine element or to draw down for installation a marine element into tensioning system 10. Active operation is easily accomplished in a combined pneumatic/hydraulic system as 42A or a pressure charged elastomeric energy cell such as 42E by increasing the gas pressure inside the tension controller 42.

Figure 11:
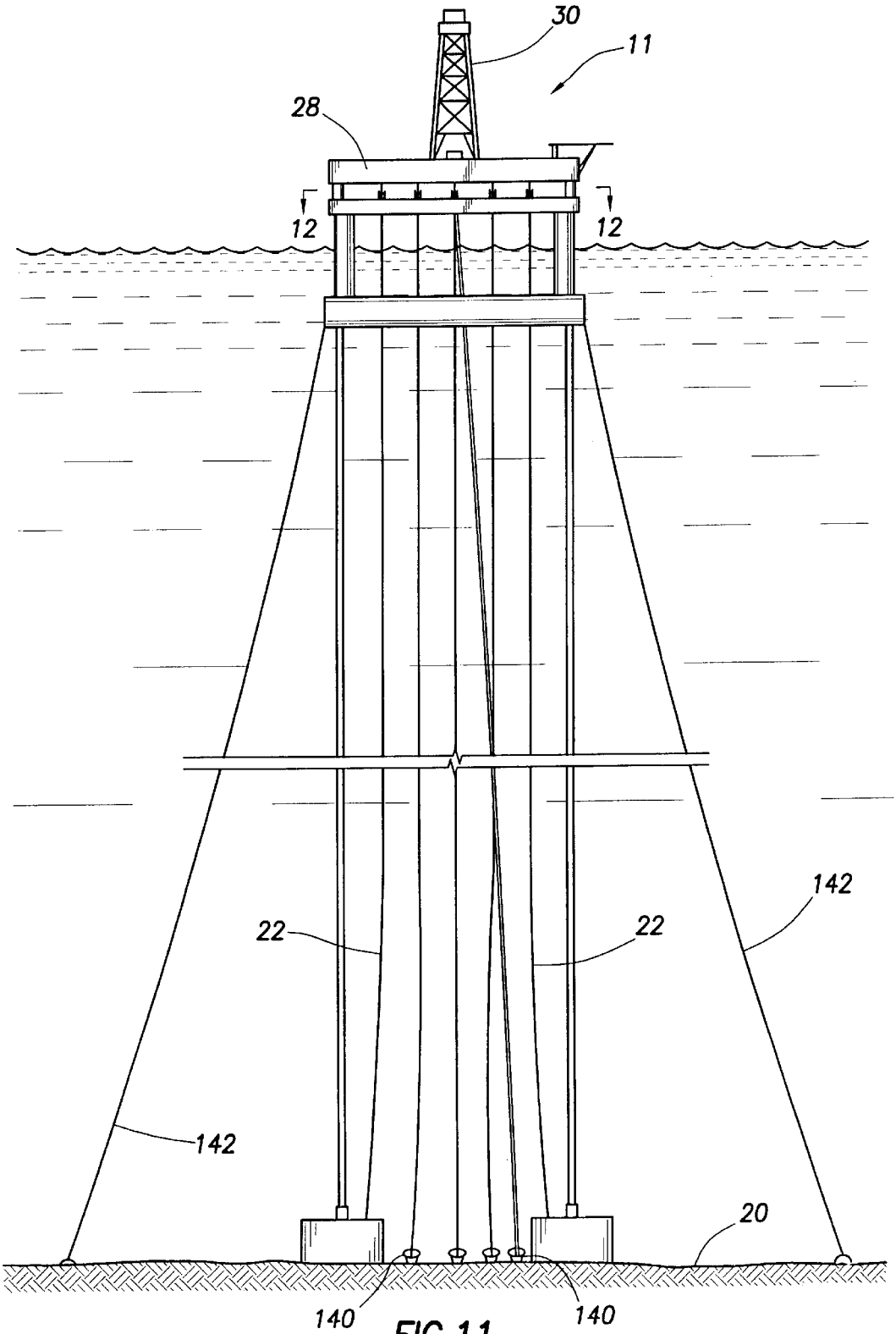
FIG. 11 is a side elevational view of a TLP biased over an additional well site.
Figure 12:
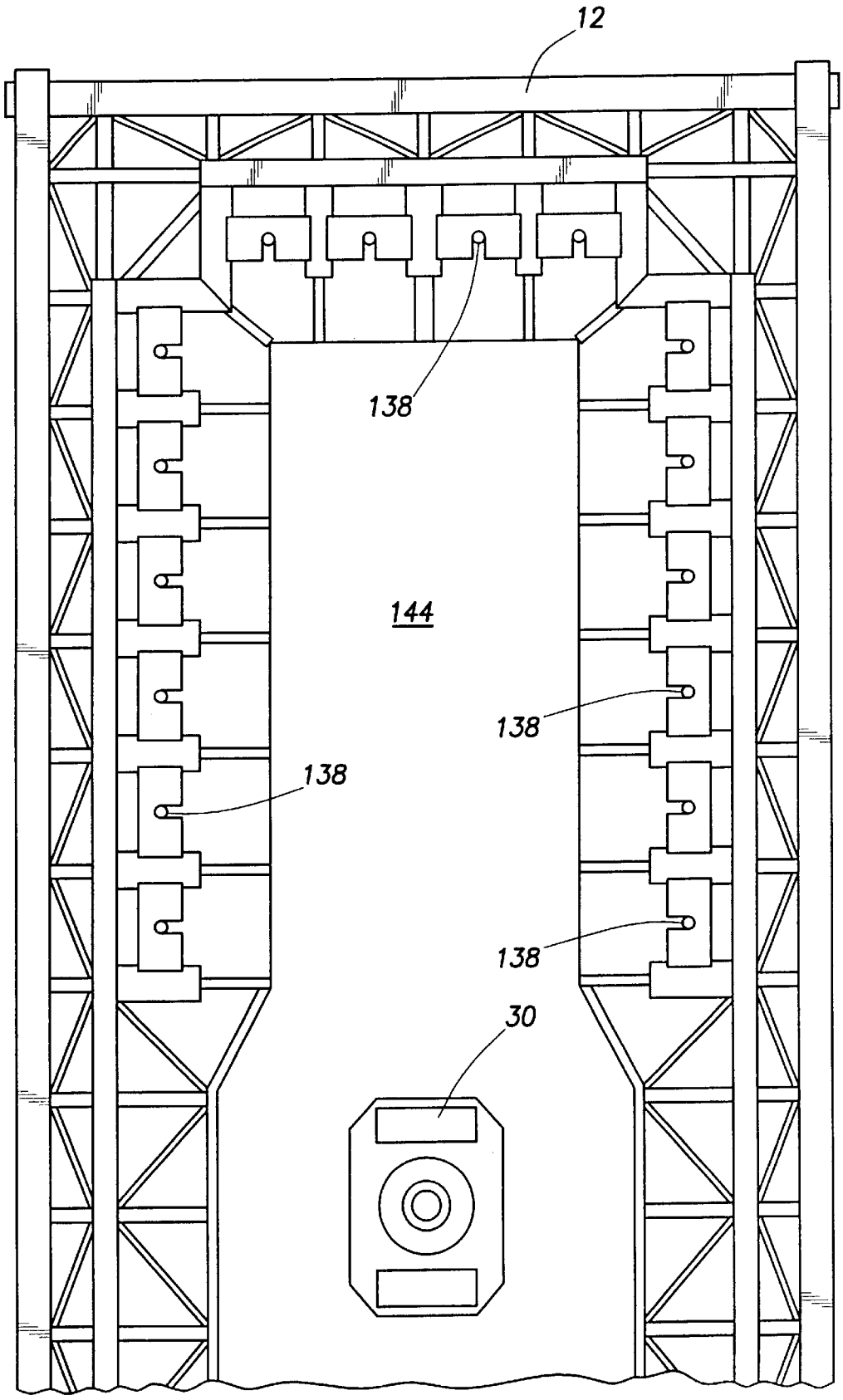
FIG. 12 is a top, cross sectional view of the well bay of the TLP of FIG. 11 taken along line 12—12.
Figure 13:
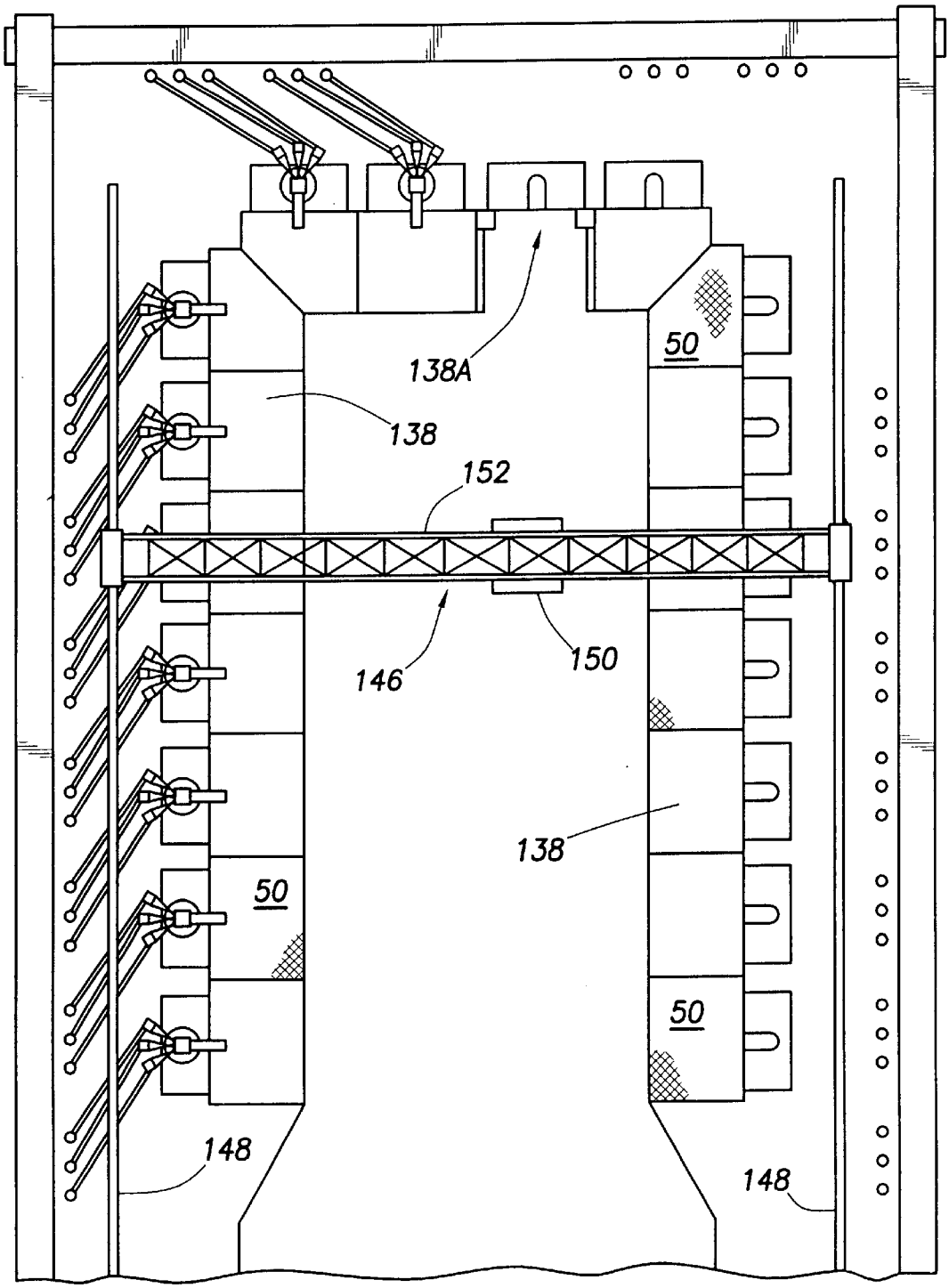
FIG. 13 is an overhead view of the well bay of the TLP FIG. 11 during placement of a riser.

FIGS. 11, 12 and 13 illustrate how the present invention facilitates certain well operations in the development of deepwater reserves. FIG. 11 illustrates TLP 11 in which a stationary central derrick 30 is used to drill and/or complete a plurality of wells 140 at ocean floor 20. Lateral mooring lines 142 are used to reposition to whole TLP within its tendon mooring in order to vertically align derrick 30 sequentially with each individual well 140 of the pattern of wells to be directly supported by the platform. This requires transfer of the risers from central derrick 30 to the risers' respective well slots 138 (represented schematically) across an extended, open well bay 144 after derrick operations are concluded for a given well. See FIG. 12 which is a partial cross sectional view taken beneath upper deck 28 of FIG. 11.

Figure 14:
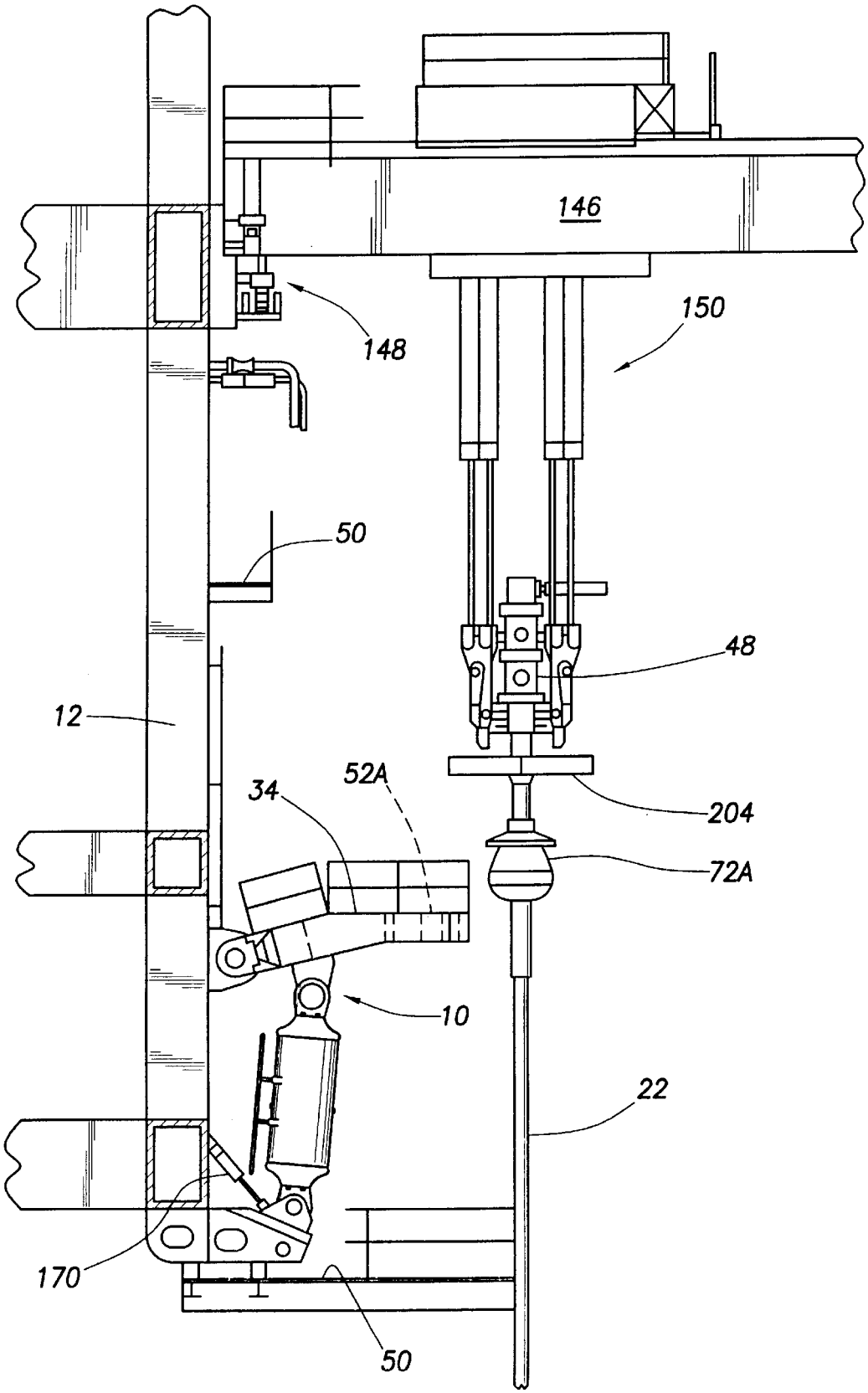
FIG. 14 is a side elevational view of a gantry crane transporting a riser for reception within a riser tensioning system in accordance with the presently preferred installation practice.

FIG. 13 illustrates the use of a gantry crane 146 in the transfer of a riser 22 from derrick 30 to tensioning system 10 in well slot 138. Gimbal assembly 52 is installed on the riser, see FIG. 7, and the riser is supported in a temporary tensioning device 150 suspended from beam 152 of gantry crane 146 for transport. See FIG. 14. Returning to FIG. 13, beam 152 travels on rails 148 and tensioning device 150 moves with and axially along the beam to present riser 22 at well slot 138A. In this embodiment, catwalk 50 is temporarily removed from well slot 138A to permit access for transferring the riser to tensioning system 10. See FIGS. 15A and 15B.

Figure 15A:
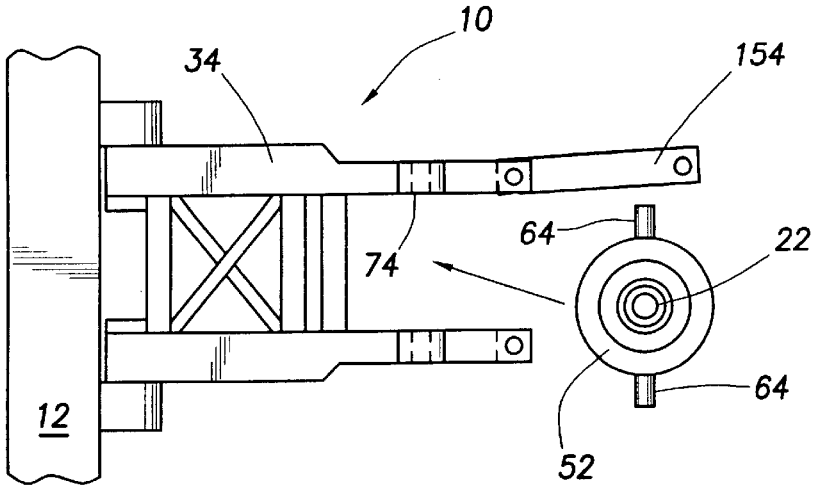
FIGS. 15A and 15B illustrate an overhead view of the reception of a riser within a tensioning system constructed in accordance with one embodiment of the present invention.
Figure 15B:
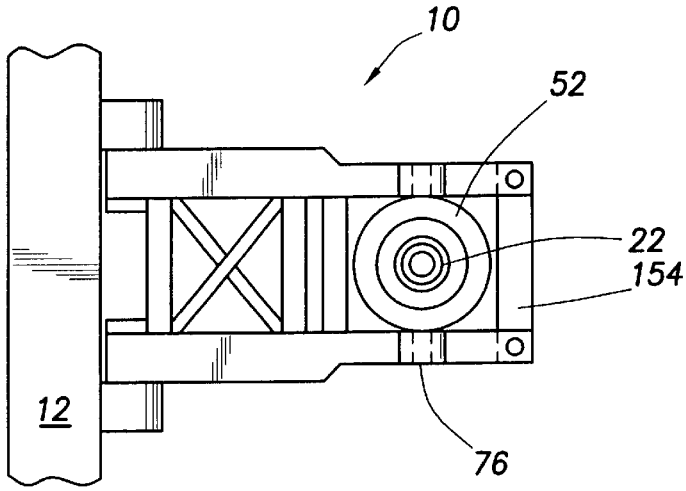

FIGS. 15A and 154B illustrate an overhead view of transferring riser 22 with gimbal assembly 52 mounted thereon to rocker arm 34. A gate 154 is opened and pivot pins 64 of the gimbal assembly are received in grooves or recesses 74 of the rocker arm. Caps 76 are installed over pivot pins 64 to secure their reception within the recesses, gate 154 is closed, tensioning system 10 is brought operational, and the load of riser 22 is transferred from temporary tensioning device 150 and released. If the riser is presented to the rocker arm when tension controller 42 is in an unloaded state, transferring the load to tensioning system 10 will cause rocker arm 34 to drop as the tension controller takes on the initial load. Various means for compensating for this effect are possible. For instance, temporary tensioning device 150 can be used to slightly stretch riser 22 immediately before transfer, so that an initial pre-tension load will be absorbed in loading tensioning system 10 during the riser transfer operation. See FIG. 14. Alternatively, ramp 166 may be used (or extended) to temporarily lower strut base connection 60, to drop the rocker arm to a lower position prior to transferring the riser, then pulling the strut base connection up the ramp for tensioning system operation after riser transfer. See the discussion of FIGS. 17A–17D below. Further, tension in a marine element such as a riser can be temporarily lowered by repositioning the tensioning system more directly over a wellhead 140 of the riser during transfer. See FIG. 11. Finally, the tensioning system itself can be preloaded, e.g. by an hydraulic cylinder temporarily drawing down the rocker arm for riser transfer. For example, pad eye 214 (see FIG. 18) can provide a place for a special hydraulic cylinder to attach either for a draw down for riser transfer, or for an alternate tension controlling strut in an emergency or service operation.

It is presently preferred to transfer the load from the temporary riser tensioner to tensioning system 10 over a number of gradual, iterative steps.

Figure 16:
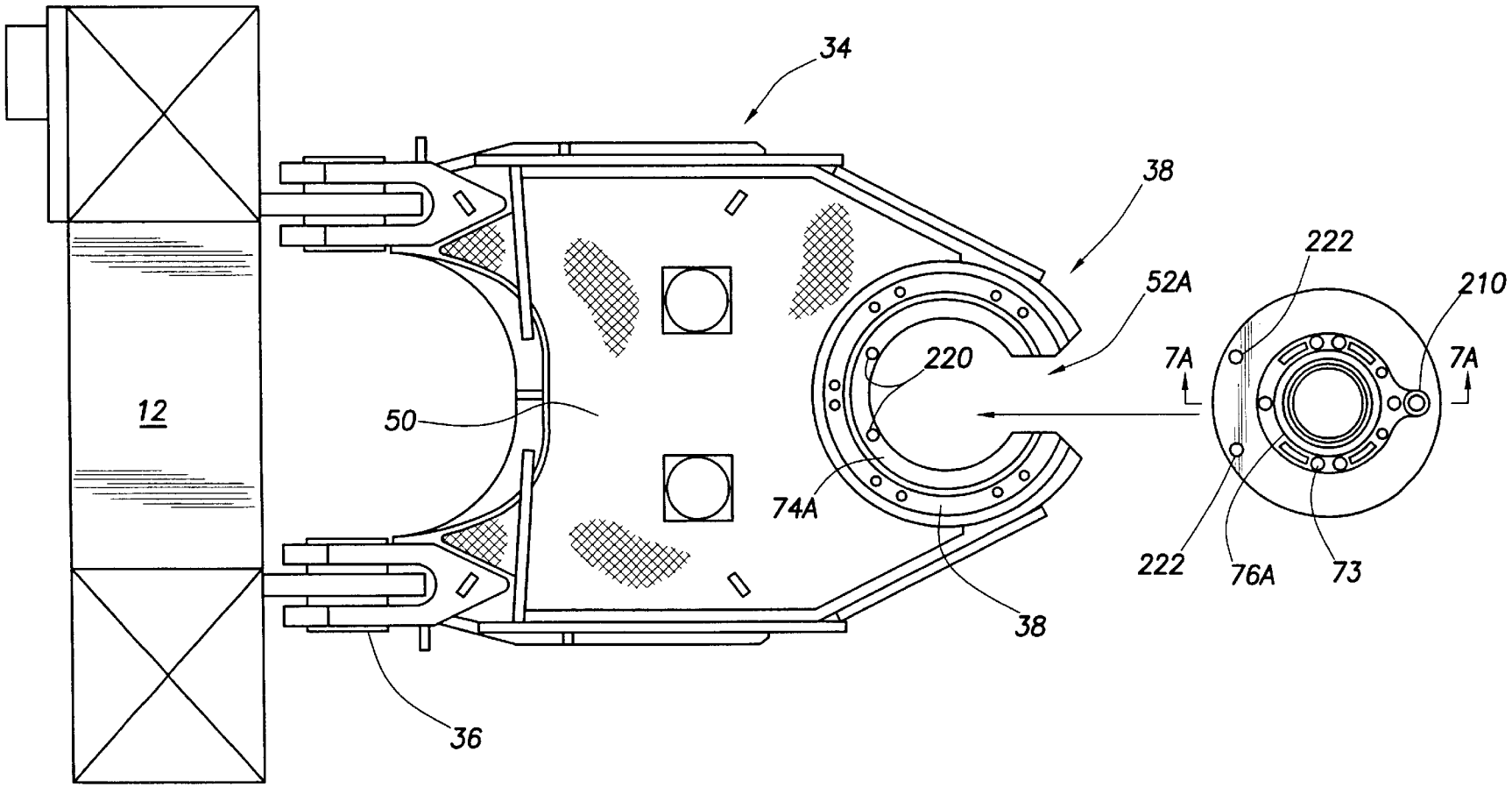
FIG. 16 is an overhead view illustrating the preferred practice of installing a riser in a tensioning system in accordance with the present invention.
Figure 17B:
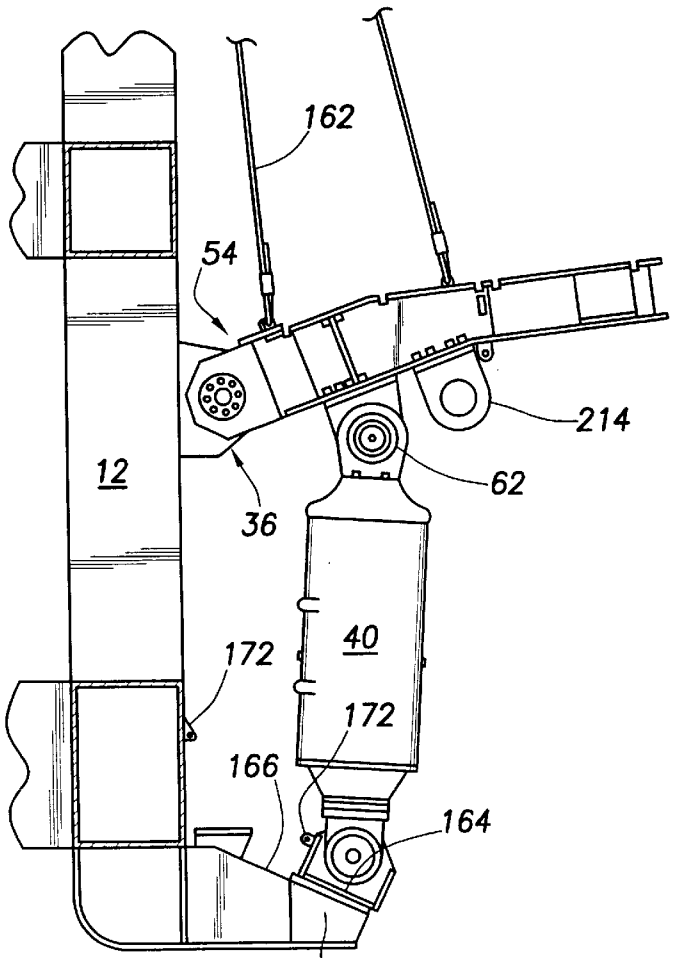
FIGS. 17A–17D illustrate in side elevational view the preferred practice for installing a tensioning system in accordance with the present invention.
Figure 17A:
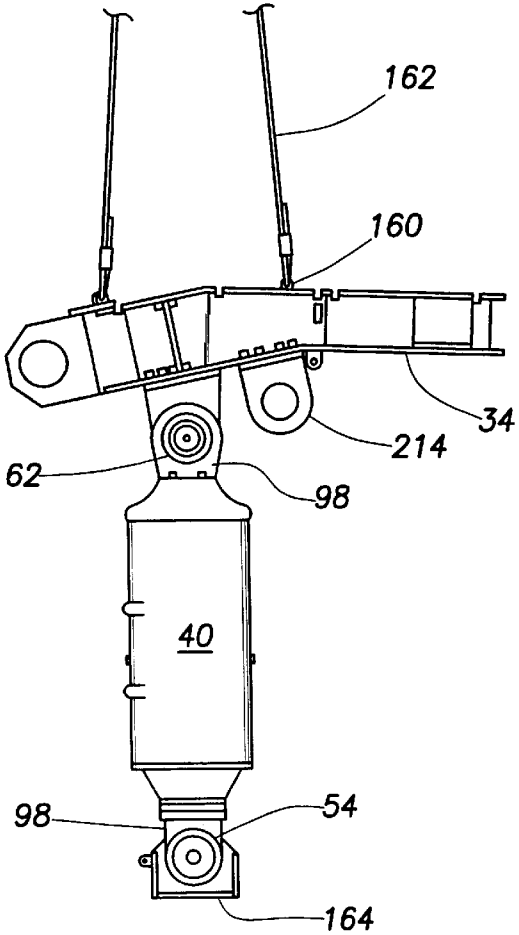
Figure 17D:
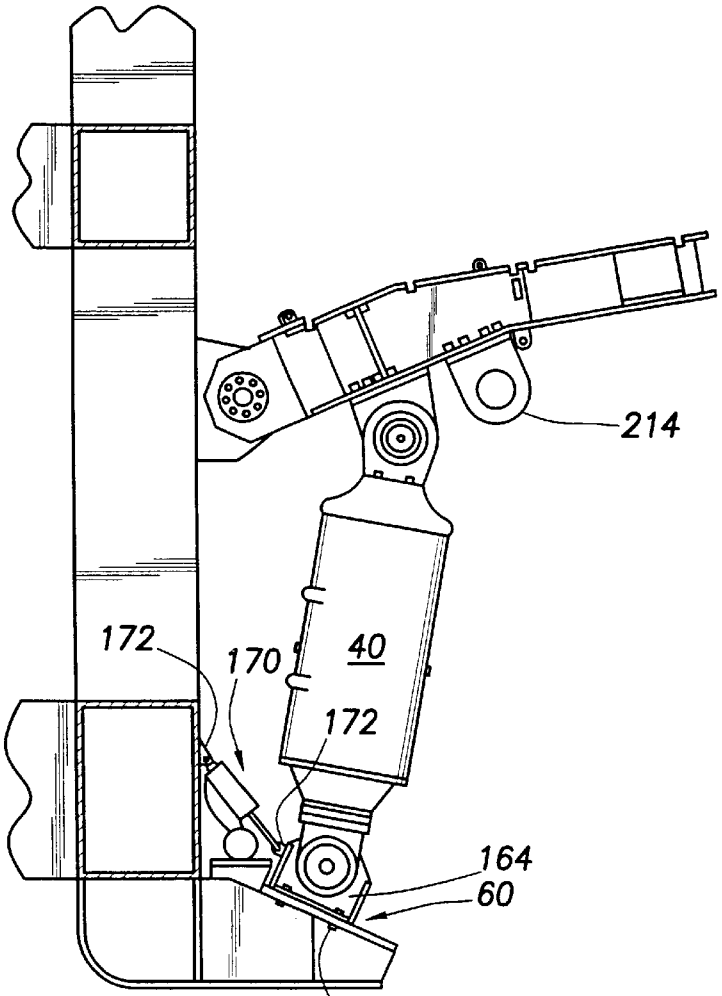
Figure 17C:
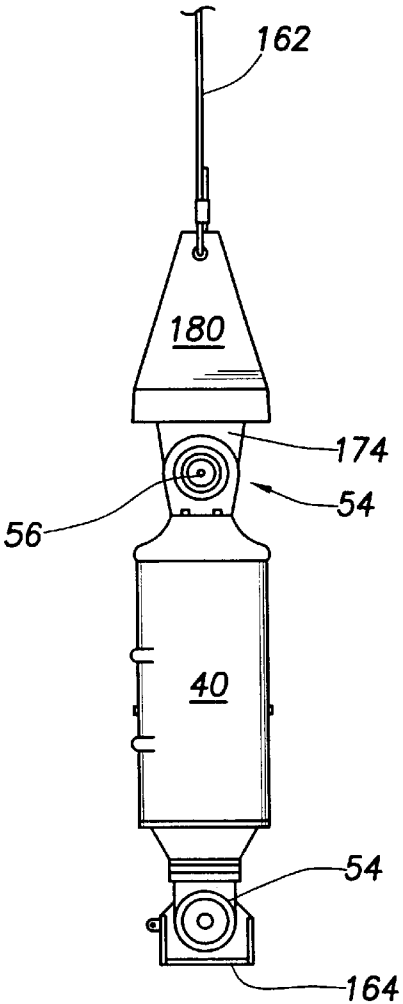

FIG. 16 illustrates an alternate and presently preferred embodiment of load connection 38 during a similar installation process. Rocker arm 34 in this embodiment presents a keyhole slot 52A through which the riser is passed and load ring 64A is lowered with the riser to reception within seat 74A presented on the shoulders of keyhole slot 52A to complete load connection 38. Alternatively, after the riser is brought within the keyhole slot, this assembly can be taken apart and lowered into place on seat 74A and there reassembled about the riser to secure load connection 38.

In the preferred embodiment, pins 220 and recesses 222 cooperate to secure the orientation of bearing housing 72A and dual axis inclinometer 210.

Another advantage of the increased use of elastomeric flex-joint 156 of the type of load connection shown in detail in FIG. 7A over gimbal assembly 52 of FIG. 7 is its ability to flex or pivot in all directions. This capability facilitates well operations such as illustrated in FIG. 11 in which TLP 11 is relocated over another well 140 and previously hung risers 20 may experience relative movement within the well slots in planes other than that defined by the arcuate movement of the supporting rocking arm.

The installation of the preferred embodiment of tensioning system 10 to superstructure 12 is illustrated in FIGS. 17A–17D. In the preferred installation sequence, a single tension controlling strut member 40 is secured to rocker arm 34 at rocker arm hinge connection 62 and the combined unit is lifted by cable 162 connected at pad eyes 160. See FIG. 17A. It is particularly convenient to premount the center tension controlling strut member in the preferred configuration in which three parallel, ganged tension controlling strut members are deployed in each tensioning system 10. Pin and clevis assembly 54 are premounted to pad eye 98 and depend from strut member 40, ready to contribute to strut base connection 60. The pin and clevis assembly for this pivotal connection provides a base plate or shoe 164 which is connectable to superstructure 12 to complete strut base connection 60 at the appropriate time in the installation sequence.

A crane, e.g. gantry crane 146 of FIG. 13, carries this rocker arm-strut assemblage to a selected well slot 138 at superstructure 12. See FIG. 17B. Shoe 164 is positioned onto ramp 166 of the superstructure and is temporarily pinned in place with pins 168. With this point of reference fixed, fulcrum connection 36 is aligned and secured. The making up of fulcrum connection 36 may be facilitated by initially securing this pin and clevis assembly 54 with an undersized, lightweight pin, e.g. one made of aluminum. After temporary make up, the aluminum pin can be driven out with its permanent replacement by use of a hydraulic tool, thereby completing fulcrum connection 36.

A hydraulic jack 170 is inserted between pad eyes 172, pins 168 temporarily securing shoe 164 at the bottom of ramp 166 are removed and the hydraulic jack is actuated to draw the shoe up ramp 166 until shoe 166 is in alignment for securing to superstructure 12 to complete rocker arm base connection 60. See FIG. 17D. Shoe 164 is then connected to the superstructure at the upper portion of ramp 166 by bolts 178 or other suitable means. Cables or lift lines 162 can be removed from rocker arm 34 once strut base connection 60 is complete.

Additional tension controlling strut members may be sequentially placed thereafter. It is convenient that each have a premounted pin and clevis assembly 54, the upper pin and clevis assembly presenting a rocker arm hinge plate 174 and the lower assembly presenting shoe 164. This arrangement facilitates completing the rocker arm hinge and strut base connections, respectively, by bolting the plates in place rather than requiring simultaneous manipulation of unwieldy strut members 40 and pins 56. Subsequent strut members 40 are lifted with a "C shaped" mount 180 capable of reaching around the side of rocker arm 34 to facilitate placing the top of rocker arm hinge plate 174 against the bottom of the rocker arm for bolting in place with minimal interference from lifting apparatus. Temporary pinning of shoe 164 to ramp 166 can help with this alignment. Subsequent use of hydraulic jack 170 to later draw shoe 164 up ramp 166 for completion of the strut base connection proceeds in accordance to the discussion above as subsequent strut members are placed. This same procedure is used for replacement of a strut member 40 during service.

Figure 18:
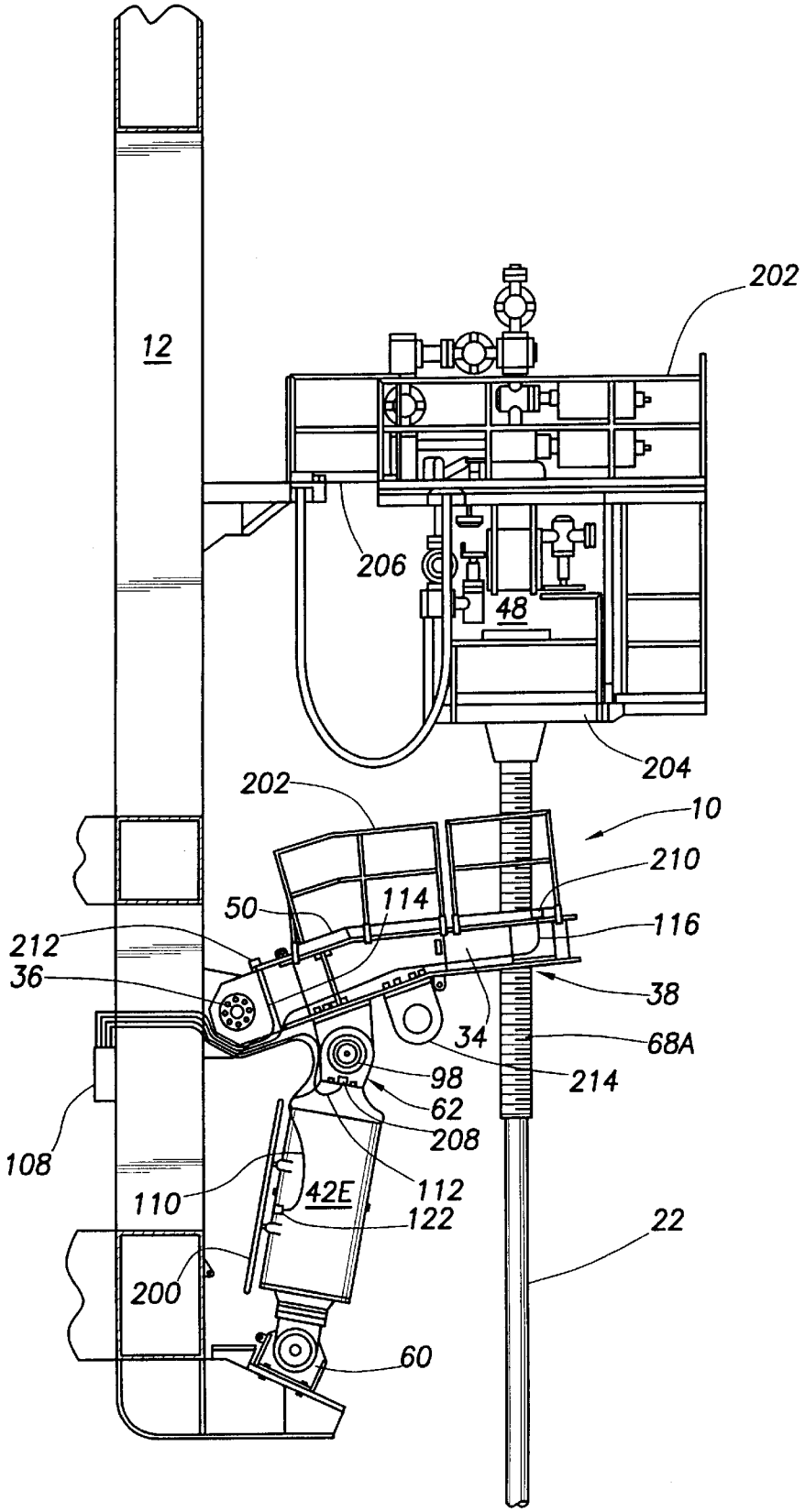
FIG. 18 is a side elevational view of the presently preferred embodiment of a riser tensioner constructed in accordance with the present invention.

FIG. 18 illustrates the preferred embodiment of the present invention in greater detail. This embodiment of tensioning system 10 deploys three pressure charged elastomeric tension controllers 42E in the form disclosed in FIG. 8F with the rocker arm 34 disclosed in FIG. 6A and the load connection disclosed in detail in FIG. 7A.

Accessibility of components for operation and service is facilitated by additional hardware such as ladders 200, walkways and work platforms 50, guard rails 202 and the use of a travelling platform 204. Traveling platform 204 is constructed about the Christmas tree after transfer of the riser is complete and the platform is directly supported by tensioning system 10 through tension joint 68A. Thus, the travelling platform is connected to and travels with riser and, more particularly, Christmas tree 48. This permits workers direct access to the Christmas tree without having to compensate for relative motion between the Christmas tree and superstructure 12. A flexible or hinged bridge 206 conveniently provides access to travelling platform 204.

FIG. 18 also discloses the instrumentation of tensioning system 10. Sensor 208 at rocker arm hinge connection 62 of tension controlling strut member 40 to rocker arm 34 directly measures the force on tension controller 42E. A dual axis inclinometer 210 is mounted on riser 20 at load connection 38 which measures any change in the riser orientation. A single axis inclinometer 212 is mounted on rocker arm 34 in an orientation to measure the rotation and thus the orientation of rocker arm 34 and pressure sensor 122 measures the pressure within pressure charged elastomeric tension controller 42E. Signals from sensor 208, dual axis inclinometer 210, inclinometer 212, and pressure sensor 122 are connected to instrumentation 108 through leads 112, 116, 114 and 110, respectively. In applications employing ganged, parallel tension controlling strut members 42 it is preferred to monitor each with separate sensors 208 and 122. The signals are processed at instrumentation 108 to monitor the operation of the tensioning system and changes in operating conditions. Information from these signals can be useful to confirm proper operation and to give early warnings of potential problems.

For example, the summed force on each of tension controllers 42E and the angle of rocker arm 34 as measured by sensor 208 and inclinometer 212 permit a direct calculation of the tension on riser 22 provided by tensioning system 10.

The effectiveness of the elastomeric elements in tension controller 42A can be monitored by sensing the pressure charge within each of the tension controllers, combining this with knowledge of the proper spring performance characteristics of by elastomeric elements 92 (see FIG. 8E) to calculate a theoretical total force resisted by each tension controller 42E and comparing this calculated force against the actual force measured at sensor 208 for that tension controller. Discrepancies indicate changes in the spring force provided by the elastomeric members and can provide an early warning of impending failure of those elastomeric members.

The sensor suite also monitors against another potential problem, vortex induced vibration in risers 22. Deepwater applications are potentially subject to unusual currents, such as eddies breaking off loop currents. Without compensation, such currents could establish harmonic resonance in the risers and cause potentially damaging vibrations. However, early detection of vibrations permits making changes in the pressure charge of tension controllers 42E, thereby altering the resonant frequencies of the risers to avoid the frequency range driven by the current.

Even so, the need to adjust the pressure charge in the tensioning elements is infrequent as are the needs for active operation of tensioning system 10. A portable form of pressure charging system 120 is therefore appropriate to serve a number of tensioning systems 10 to periodically adjust for creep in elastomeric members 92, avoid resonant frequencies in the risers responding to abnormal currents, adjust for temporary loads such as work over equipment supported on travelling platform 204, etc., see FIG. 8E.

Other modifications, changes and substitutions are intended in the foregoing disclosure and in some instances some features of the invention will be employed without a corresponding use of other features. Accordingly, it is appropriate that the appended claims be construed broadly and in the manner consistent with the spirit and scope of the invention herein.

What is claimed is:

1. A tensioning system for directly supporting a marine element which extends from a fixed lower end at a subsea base to an upper end presented at a moving superstructure of a floating platform, said tensioning system comprising:

a lever action rocker arm pivotally connected both directly to the superstructure and to the upper end of the marine element; and a tension controlling strut member pivotally connected both directly to the superstructure and to the rocker arm;

whereby said tension system is the direct, primary motion compensation between the marine element and the moving superstructure of the floating platform.

2. A marine tensioning system in accordance with claim 1 wherein the tension controlling strut member comprises a pneumatic spring.

3. A marine tensioning system in accordance with claim 1 wherein the tension controlling strut member comprises an hydraulic cylinder.

4. A marine tensioning system in accordance with claim 1 wherein the tension controlling strut member comprises a combined pneumatic/hydraulic compensation system.

5. A marine riser tensioning system in accordance with claim 1 wherein the tension controlling strut member comprises a mechanical spring element.

6. A marine tensioning system in accordance with claim 5 wherein the mechanical spring element comprises an elastomeric spring.

7. A marine tensioning system in accordance with claim 6 wherein the elastomeric spring is pressure charged.

8. A marine tensioning system for directly supporting an elongated marine element which extends from a fixed lower end at a subsea base to an upper end presented at a moving, floating superstructure, said tensioning system comprising:

a lever action rocker arm pivotally connected to the superstructure at a fulcrum connection and to the upper end of the marine element at a load connection spaced a distance $L_1$ from the fulcrum connection;

a tension controlling strut member comprising:

an elongated strut;

a first strut connection pivotally attaching the strut to the superstructure;

a second strut connection pivotally attaching the strut to the rocker arm at a position spaced a distance $L_2$ on the rocker arm from the fulcrum connection such that distance $L_1$ exceeds distance $L_2$;

a tension controller within the strut between the first and second strut connections, said tension controller comprising a pressure charged elastomeric spring.

9. A riser tensioning system for directly supporting a riser which extends from a fixed lower end at a subsea base to a moving superstructure, said riser tensioning system comprising:

a lever action rocker arm, comprising:

a plurality of elongated lever arms;

a fulcrum connection pivotally attaching the rocking arm to the moving superstructure; and a load connection spaced apart from the fulcrum connection on the rocking arm and pivotally attaching the rocking arm to the riser; and a tension controlling strut member, comprising:

an elongated strut:

a first strut connection pivotally attaching the strut to the moving superstructure;

a second strut connection pivotally attaching the strut to the lever arm at a position spaced apart from the fulcrum; and a tension controller within the strut member between the first and second strut connections.

10. A riser tensioning system in accordance with claim 9 wherein the second strut connection attaches the tension controlling strut member to the rocking arm between the fulcrum connection and the load connection.

11. A riser tensioning system in accordance with claim 10 wherein the first strut connection is attached to the superstructure below the fulcrum connection.

12. A riser tensioning system in accordance with claim 9 wherein the tension controller comprises an elastomeric shock cell.

13. A riser tensioning system in accordance with claim 9 wherein the tension controller is a pneumatic spring.

14. A riser tensioning system in accordance with claim 9 wherein the tension controller is an hydraulic cylinder.

15. A riser tensioning system in accordance with claim 9 wherein the tension controller is a combined pneumatic/hydraulic compensation system.

16. A riser tensioning system in accordance with claim 9 wherein the load connection is spaced a distance $L_1$ along the rocker arm from the fulcrum connection and the second strut connection is spaced a distance $L_2$ from the fulcrum connection such that distance $L_1$ is greater than distance $L_2$.

17. A riser tensioning system in accordance with claim 16 wherein the tension controller is a mechanical spring element.

18. A riser tensioning system in accordance with claim 17 age wherein the mechanical spring element is an elastomeric spring.

19. A riser tensioning system in accordance with claim 18 wherein the elastomeric spring is pressure charged.

20. A riser tensioning system for directly supporting a marine riser which extends from a fixed lower end at a subsea base to a moving superstructure, said marine riser tensioning system comprising:

a lever action rocker arm, comprising:

at least one elongated lever arm:

a fulcrum connection pivotally attaching the rocking arm to the moving superstructure; and a load connection pivotally connecting the marine riser to the rocking arm;

a tension controlling strut member, comprising:

an elongated strut;

a first strut connection pivotally connecting the strut to the moving superstructure at a position below the fulcrum connection;

a second strut connection pivotally connecting the strut to the lever arm at a position on the rocking arm between the fulcrum connection and the load connection; and a tension controller between the first and second strut connections, comprising a pressure charged elastomeric spring.

21. A method for supplying tension to a marine element across a direct connection between the marine element and a superstructure in relative motion therewith, said method comprising:

pivotally connecting a lever arm to both the superstructure and the marine element;

pivotally connecting a tension controlling member to both the superstructure and the lever arm; and applying a controlled force to the lever arm, and thereby the marine element, through the tension controlling member.

22. A method for tensioning a marine riser which extends from a fixed lower end at a subsea base to an upper end at a moving superstructure of a platform which is subjected to the surface action of the ocean, said method comprising:

pivotally connecting a rocker arm directly to the moving superstructure and to the marine riser; and operably connecting a tension controlling member to both the superstructure and the rocker arm in such a manner as to allow rotation of the rocker arm at a substantially constant tension in response to a relative motion between the superstructure and the marine riser;

pivotally connecting a lever arm to both the superstructure and the marine element;

pivotally connecting a tension controlling member to both the superstructure and the lever arm; and applying a controlled force to the lever arm, and thereby marine element, through the tension controlling member.

23. A method for tensioning a marine riser in accordance with claim 22 wherein operably connecting the tension controlling member comprises:

providing an axially compressing tension controlling member within an elongated strut;

pivotally connecting an end of the strut to the lever arm; and pivotally connecting the other end of the strut to the superstructure.

24. A method for installing a riser tensioning system on a floating superstructure, comprising:

lifting a rocker arm with at least a first tension controlling strut member to a selected well slot the at least first tension controlling strut member being connected to the rocker arm through a pivoting rocker arm hinge connection on one end and having a pivoting strut base connection including a shoe depending from the other end;

temporarily securing the shoe of the tensioning controlling strut member at a first position on a ramp supported by the superstructure;

aligning and making up a fulcrum connection pivotally joining the rocker arm to the superstructure; and drawing the shoe up the ramp from the first position and securing the shoe to the ramp at a second position, elevated with respect to the first position to complete the strut base connection and preload a tension controller within the tension controlling strut member.

25. A method or installing a riser tensioning system in accordance with claim 24 wherein drawing the shoe up the ramp comprises:

connecting a hydraulic jack between the shoe and the superstructure;

releasing the shoe from the first position on the ramp; and activating the hydraulic jack to draw the shoe up the ramp to the second position.

26. A method for installing a riser tensioning system in accordance with claim 25, further comprising installing additional tension controlling members in parallel with the first tensioning controlling strut member:

providing a pivoting rocker arm hinge connection including a rocker arm hinge plate at one end of the additional tensioning controlling strut member;

providing a pivoting strut base connection having a shoe at the other end of the additional tension controlling strut member;

temporarily securing the shoe to the ramp at the first position;

aligning the rocker arm hinge plate with the rocker arm and making up another rocker arm hinge connection pivotally connecting the additional tensioning controlling strut member to the rocker arm; and drawing the shoe of the additional tension controlling strut member up the ramp and securing the shoe to the ramp at a second position which is elevated with respect to the first position.

27. A method for installing a riser tensioning system in accordance with claim 26 wherein lifting the additional tension controlling strut member comprises:

securing the rocker arm hinge plate of the additional tension controlling strut member to a C-shaped mount;

moving the additional tension controlling strut member by a lift line from a crane connected to the C-shaped mount; and positioning the rocker arm hinge plate against an underside of the rocker arm by bringing the lift line over the rocker arm with the C-shaped mount reaching around the side of the rocker arm.

28. A riser tensioner system for applying a tensioning force to a riser and allowing a floating platform to move within a preselected range along a longitudinal axis of said riser, said system comprising:

a spring and a lever forming an assembly, said assembly being coupled to said riser and to said platform, said spring having a spring rate, said lever being coupled to said spring to control orientation of said spring relative to said riser in response to relative movement between said platform and said riser along said longitudinal axis, thereby controllably varying a magnitude of a vertical component of said spring rate in proportion to said relative movement such that said tensioning force remains substantially constant through said range.

29. The system, as set forth in claim 28, further comprising:

a plurality of spring and lever assemblies being symmetrically disposed about said longitudinal axis of said riser, each of said assemblies being coupled to said riser and to said platform, each of said springs remaining in compression throughout said range and each of said springs having a spring rate, each of said levers being coupled to a respective spring and to at least one of said riser and said platform to control orientation of said respective spring relative to said riser in response to movement between said platform and said riser along said longitudinal axis, thereby controllably varying a magnitude of a vertical component of said spring rate of each of said springs in proportion to said relative movement so that said tensioning force remains substantially constant through said range.

30. A riser tensioner system for applying a tensioning force to a riser and allowing a floating platform to move within a preselected range along a longitudinal axis of said riser, said system comprising:

a spring having a first end and a second end, said first end being pivotally coupled to said floating platform, said spring having a preselected spring rate;

a lever having a first end and a second end, said first end of said lever being pivotally coupled to said floating platform, and said second end of said lever being pivotally coupled to said riser;

said second end of said spring being pivotally coupled to a preselected location on said lever, thus forming an angle between a longitudinal axis of said spring and the longitudinal axis of said riser, said angle determining a vertical magnitude of said spring rate;

said lever varying said vertical magnitude of said spring rate in proportion to movement of said platform so that said tensioning force remains substantially constant through said range.

31. The system, as set forth in claim 30, wherein said spring remains in compression throughout said range.

32. The system, as set forth in claim 30, further comprising:

a plurality of springs each having a first end and a second end and each spring having a preselected spring rate, said first end of each spring being pivotally coupled to said floating platform;

a plurality of levers each having a first end and a second end, said first end of each lever being pivotally coupled to said floating platform, and said second end of each lever being pivotally coupled to said riser;

said second end of each spring being pivotally coupled to a preselected location on one of said respective levers, thus forming an angle between a longitudinal axis of said spring and the longitudinal axis of said riser, said angle determining a vertical magnitude of said spring rate for said respective spring;

each lever varying said vertical magnitude of said spring rate of said respective spring in proportion to movement of said platform so that said tensioning force remains substantially constant through said range.

33. The system, set forth in claim 32, further comprising;

a plurality of motion compensation bearings being pivotally coupled to said riser, each of said bearings being slidably coupled to one of said second ends of said plurality of respective levers.

34. The system, as set forth in claim 33, wherein:

said first end of each of said springs is coupled to said platform below said first end of each of said respective levers, whereby movement between said riser and said platform in a first direction causes each of said springs to increasingly compress and each of said angles to increase, and movement between said riser and said platform in a second direction opposite said first direction causes each of said springs to decreasingly compress and each of said angles to decrease.

35. The system, as set forth in claim 33, wherein:

said first end of each of said springs is coupled to said platform above said first end of each of said respective levers, whereby movement between said riser and said platform in a first direction causes each of said springs to increasingly compress and each of said angles to decrease, and movement between said riser and said platform in a second direction opposite first direction causes each of said springs to decreasingly compress and each of said angles to increase.

36. The system, as set forth in claim 33 further comprising:

a plurality of lugs, one of said plurality of lugs extending outwardly from each respective lever, said second end of each of said springs being pivotally coupled to said respective lug.

37. The system, as set forth in claim 36, wherein:

said first end of each of said springs is coupled to said platform above said first end of each of said respective levers, whereby movement between said riser and said platform in a first direction causes each of said springs to increasingly compress and each of said angles to decrease, and movement between said riser and said platform, in a second direction opposite first direction causes each of said springs to decreasingly compress and each of said angles to increase.

38. The system, as set forth in claim rein each of said levers comprises:

a plurality of first arms, each of said first arms having a first end and a second end, said first end of each of said first arms being pivotally coupled to said platform and said second end of each of said first arms being pivotally coupled to said riser; and a plurality of second arms, each of said second arms having a first end and a second end, said first end of each of said second arms being pivotally coupled to said platform and said second end of each of said second arms being pivotally coupled to said first arms.

39. The system, as set forth in claim 38, wherein:

said second end of each spring is Pivotally coupled to said second end of each of said respective second arms.

40. The system, as set forth in claim 39, further comprising:

a plurality of connecting arms, each of said connecting arms having a first end and a second end, said first end of each of said connecting arms being pivotally coupled to said second end of each of said respective second arms, and said second end of each of said connecting arms being pivotally coupled to a preselected location on each of said respective first arms.

41. A riser tensioner system containing:

a first spring having a first end and a second end, said first end being pivotally coupled to a riser and forming a first angle between a longitudinal axis of said first spring and a longitudinal axis of said riser;

a second spring having a first end and a second end, said first end of said second spring being pivotally coupled to said second end of said first spring to form a junction, and said second end of said second spring being pivotally coupled to a floating platform and forming a second angle between a longitudinal axis of said second spring and said longitudinal axis of said riser;

a lever having a first end and a second end, said first end of said lever being pivotally coupled to said floating platform, and said second end of said lever being pivotally coupled to said junction;

said first and second springs being adapted to increasingly compress in response to said platform moving relatively to said riser along said longitudinal axis of said riser in a first direction, whereby movement in said first direction causes said first and second angles to increase; and said first and second springs being adapted to decreasingly compress in response to said platform moving relatively to said riser along said longitudinal axis of said riser in a second direction, whereby movement in said second direction causes said first and second angles to decrease.

42. A method for applying a tensioning force to a riser while allowing limited movement between the riser and a floating platform, comprising the steps of:

pivotally coupling a first end of a first compression spring to said riser and forming a first angle between a longitudinal axis of said first compression spring and a longitudinal axis of said riser, said first compression spring having a first spring rate having a vertical magnitude being determined by said first angle;

pivotally coupling a second end of said first compression spring to a first end of a second compression spring to form a junction and to form a second angle between a longitudinal axis of said second compression spring and said longitudinal axis of said riser, said second compression spring having a second spring rate having a vertical magnitude being determined by said second angle;

pivotally coupling a second end of said second compression spring to said platform; and pivotally coupling a first end of a lever to said platform;

pivotally coupling a second end of a lever to said junction; and decreasing said vertical magnitude of said first and second spring rates in proportion to said movement by increasing said first and second angles when said movement causes said respective first and second springs to compress so that said tensioning force remains substantially constant.

43. A method for applying a tensioning force to a riser while allowing limited movement between the riser and a floating platform, comprising the steps of:

pivotally coupling a first end of a lever to said platform;

pivotally coupling a second end of said lever to said riser;

pivotally coupling a first end of a compression spring to said platform and forming an angle between a longitudinal axis of said compression spring and a longitudinal axis of said riser, said compression spring having a spring rate having a vertical magnitude being determined by said angle; and pivotally coupling a second end of said compression spring at a preselected location on said lever so that vertical movement in a first direction between said riser and said platform causes said compression spring to increasingly compress and said angle to increase.

44. The method, as set forth in claim 39, wherein said step of coupling said first end of said compression spring to said platform is accomplished by:

coupling said first end to a mounting bracket being fixedly coupled to said platform at a location below said first end of said lever.

45. A method for applying a tensioning force to a riser while allowing limited movement between the riser and a floating platform, comprising the steps of:

pivotally coupling first ends of a plurality of levers to said platform;

pivotally coupling second ends of said plurality of levers to said riser;

pivotally coupling first ends of a like plurality of compression springs to said platform and forming an angle between a longitudinal axis of each of said compression springs and a longitudinal axis of said riser, each of said compression springs having a spring rate having a vertical magnitude being determined by said respective angle; and pivotally coupling second ends of said plurality of compression springs at a preselected location on said respective levers, whereby movement in a first direction between said riser and said platform causes each of said compression springs to increasingly compress and each of said angles to increase.

46. The method, as set forth in claim 45, wherein said step of coupling said first ends of said compression springs to said platform is accomplished by:

coupling each of said first ends to a respective mounting bracket being fixedly coupled to said platform at a location below said first ends of said respective levers.

47. The method, as set forth in claim 45, wherein the step of pivotally coupling said second ends of said plurality of levers to said riser is accomplished by:

pivotally coupling a plurality of motion compensation bearings to said riser; and slidably coupling each of said second ends of said plurality of levers to one of said respective motion compensation bearings.

48. A riser tensioner system for applying a tensioning force to a riser and allowing a floating platform to move within a preselected range along a longitudinal axis of said riser, said system comprising:

a spring assembly being adapted for coupling said riser to said platform and having a preselected spring rate, said assembly being configured for varying a magnitude of a vertical component of said spring rate in proportion to movement of said platform such that said tensioning force remains substantially constant throughout said range, wherein said spring assembly comprises:

a first spring having a first end and a second end, said first end being pivotally coupled to said platform and said second end being pivotally coupled to said riser; and a second spring having a first end and a second end, said first end of said second spring being pivotally coupled to said platform at a location below said first end of said first spring and said second end of said second spring being pivotally coupled to said riser.

49. The system, as set forth in claim 48, wherein:

said first spring has a first spring rate and said second spring has a second spring rate, each of said spring rates having a vertical component along said longitudinal axis of said riser.

50. The system, as set forth in claim 49 wherein:

movement between said riser and said platform in a first direction causes said first and second springs to pivot relative to said riser such that a sum of said vertical components of said first and second spring rates varies directly with and inversely proportional to said movement.

51. The system, as set forth in claim 48, further comprising:

a plurality of spring assemblies being symmetrically disposed about said longitudinal axis of said riser and coupling said riser to said platform, said assemblies having springs which remain in compression throughout said range and define a spring rate for said system, said assemblies being configured for varying a magnitude of a vertical component of said spring rate in proportion to movement of said platform such that said tensioning force remains substantially constant throughout said range.

52. A riser tensioner system for applying a tensioning force to a riser and allowing a floating platform to move within a preselected range along a longitudinal axis of said riser, said system comprising:

spring means for providing said tensioning force, said spring means having a predetermined spring rate and being coupled to said platform and to said riser; and lever means for controllably varying a vertical component of said predetermined spring rate by controlling orientation of said spring means relative to said riser in response to relative movement between said riser and said platform along said longitudinal axis, said lever means being coupled to said spring means and to at least one of said riser and said platform.

53. A riser tensioner system for applying a tensioning force to a riser and allowing a floating platform to move within a preselected range along a longitudinal axis of said riser, said system comprising:

spring means for providing said tensioning force, said spring means having a predetermined spring rate and being coupled to at least one of said platform and said riser; and lever means for controllably varying a vertical component of said predetermined spring rate by controlling orientation of said spring means relative to said riser in response to relative movement between said riser and said platform along said longitudinal axis, said lever means being coupled to said spring means and to said riser and said platform.

54. A riser tensioner system for applying a tensioning force to a riser and allowing a floating platform to move within a preselected range along a longitudinal axis of said riser, said system comprising:

a plurality of springs and a plurality of levers forming a plurality of assemblies, said assemblies being coupled to said riser and to said platform, each said spring having a spring rate and remaining in compression throughout said preselected range of motion, each of said levers being coupled to a respective spring and to at least one of said riser and said platform to control orientation of said respective spring relative to said riser in response to movement between said platform and said riser along said longitudinal axis said lever being coupled to said spring to control orientation of said spring relative to said riser in response to relative movement between said platform and said riser along said longitudinal axis, thereby controllably varying a magnitude of a vertical component of said spring rate in proportion to said relative movement such that said tensioning force remains substantially constant through said range.

55. A riser tensioner system for applying a tensioning force to a riser and allowing a floating platform to move within a preselected range along a longitudinal axis of said riser, said system comprising a plurality of springs each having a first end and a second end and each spring having a preselected spring rate, said first end of each spring being pivotally coupled to said floating platform;

a plurality of levers each having a first end and a second end, said first end of each lever being pivotally coupled to said floating platform, and said second end of each lever being pivotally coupled to said riser, each lever having a plurality of first arms, each of said first arms having a first end and a second end, said first end of each of said first arms being pivotally coupled to said platform and said second end of each of said first arms being pivotally coupled to said riser;

said second end of each spring being pivotally coupled to a preselected location on one of said respective levers, thus forming an angle between a longitudinal axis of said spring and the longitudinal axis of said riser, said angle determining a vertical magnitude of said spring rate for said respective spring;

each lever varying said vertical magnitude of said spring rate of said respective spring in proportion to movement of said platform so that said tensioning force remains substantially constant through said range; and a plurality of motion compensation bearings being pivotally coupled to said riser, each of said bearings being slidably coupled to one of said second ends of said plurality of respective levers.

56. A riser tensioner system containing:

a first spring having a first end and a second end, said first end being pivotally coupled to a riser and forming a first angle between a longitudinal axis of said first spring and a longitudinal axis of said riser;

a second spring having a first end and a second end, said first end of said second spring being pivotally coupled to said second end of said first spring to form a junction, and said second end of said second spring being pivotally coupled to a floating platform and forming a second angle between a longitudinal axis of said second spring and said longitudinal axis of said riser;

a lever having a first end and a second end, said first end of said lever being pivotally coupled to said floating platform, and said second end of said lever being pivotally coupled to said junction;

said first and second springs being adapted to increasingly compress in response to said platform moving relatively to said riser along said longitudinal axis of said riser in a first direction, whereby movement in said first direction causes said first and second angles to increase; and said first and second springs being adapted to decreasingly compress in response to said platform moving relatively to said riser along said longitudinal axis of said riser in a second direction, whereby movement in said second direction causes said first and second angles to decrease.

57. A riser tensioner system for applying a tensioning force to a riser and allowing a floating platform to move within a preselected range along a longitudinal axis of said riser, said system comprising:

a spring assembly being adapted for coupling said riser to said platform and having a preselected spring rate, said assembly being configured for varying a magnitude of a vertical component of said spring rate in proportion to movement of said platform such that said tensioning force remains substantially constant throughout said range, wherein said spring assembly comprises:

a first spring having a first end and a second end, said first end being pivotally coupled to said platform and said second end being pivotally coupled to said riser through a lever arm; and a second spring having a first end and a second end, said first end of said second spring being pivotally coupled to said platform at a location below said first end of said first spring and said second end of said second spring being pivotally coupled to said riser through a lever arm.

58. The system, as set forth in claim 57, wherein:

said first spring has a first spring rate and said second spring has a second spring rate, each of said spring rates having a vertical component along said longitudinal axis of said riser.

59. The system, as set forth in claim 58 wherein:

movement between said riser and said platform in a first direction causes said first and second springs to pivot relative to said riser such that a sum of said vertical components of said first and second spring rates varies directly with and inversely proportional to said movement.

60. The system, as set forth in claim 57, further comprising:

a plurality of spring assemblies being symmetrically disposed about said longitudinal axis of said riser and coupling said riser to said platform through a lever arm, said assemblies having springs which remain in compression throughout said range and define a spring rate for said system, said assemblies being configured for varying a magnitude of a vertical component of said spring rate in proportion to movement of said platform such that said tensioning force remains substantially constant throughout said range.

* * * * *